US007094191B2

(12) United States Patent
Fujiwara et al.

(10) Patent No.: US 7,094,191 B2
(45) Date of Patent: Aug. 22, 2006

(54) PRESS ROLL

(75) Inventors: Haruyoshi Fujiwara, Hiroshima-ken (JP); Tetsuo Makino, Hiroshima-ken (JP); Hidemasa Iijima, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 367 days.

(21) Appl. No.: 10/416,332

(22) PCT Filed: Jun. 28, 2002

(86) PCT No.: PCT/JP02/06582

§ 371 (c)(1),
(2), (4) Date: May 8, 2003

(87) PCT Pub. No.: WO03/004763

PCT Pub. Date: Jan. 16, 2003

(65) Prior Publication Data

US 2004/0014572 A1 Jan. 22, 2004

(30) Foreign Application Priority Data

Jul. 2, 2001 (JP) ..... 2001-201216

(51) Int. Cl.
*B25F 5/02* (2006.01)

(52) U.S. Cl. ..... 492/47; 492/20; 492/26; 492/45

(58) Field of Classification Search ..... 492/47, 492/20, 26, 22, 45
See application file for complete search history.

(56) References Cited

U.S. PATENT DOCUMENTS

| | | | | |
|---|---|---|---|---|
| 1,444,314 | A * | 2/1923 | Herder | 451/505 |
| 4,625,376 | A | 12/1986 | Schiel et al. | |
| 4,878,281 | A | 11/1989 | Flämig et al. | |
| 4,944,089 | A | 7/1990 | Flämig et al. | |

FOREIGN PATENT DOCUMENTS

| | | |
|---|---|---|
| JP | 1-246489 | 10/1989 |
| JP | 3-41586 | 6/1991 |
| JP | 10-158987 | 6/1998 |
| WO | 92/08002 | 5/1992 |

* cited by examiner

*Primary Examiner*—Marc Jimenez
(74) *Attorney, Agent, or Firm*—Wenderoth, Lind & Ponack, L.L.P.

(57) ABSTRACT

A press roll is employed in the press section, calender section, etc., of a papermaking machine. The press roll includes a first tapered surface (11*a*) and a first clamping surface (12*a*). The first tapered surface (11*a*) is formed in the outer peripheral surface of the supporting head (11) and diminishes in outside diameter toward its axially outer end. The first clamping surface (12*a*) is formed in the inner peripheral surface of the clamping member (12) and coincides with the first tapered surface (11*a*). With the first tapered surface (11*a*) and the first clamping surface (12*a*), a blanket (10) is clamped on the first tapered surface (11*a*) in a perpendicular direction. In this way, the blanket (10) can be exchanged easily and uniformly in a short time.

20 Claims, 21 Drawing Sheets

10: BLANKET
11: SUPPORTING HEAD
11a: FIRST TAPERED SURFACE
11d: INNER TAPERED SURFACE
12: FLANGE (CLAMPING MEMBER)
12a: FIRST CLAMPING SURFACE
13: POSITIONING PIN
14: ATTACHING BOLT (CLAMPING MEANS)
20: SUPPORTING BODY
44: COUNTER ROLL

10: BLANKET
11: SUPPORTING HEAD
11a: FIRST TAPERED SURFACE
11d: INNER TAPERED SURFACE
12: FLANGE (CLAMPING MEMBER)
12a: FIRST CLAMPING SURFACE
13: POSITIONING PIN
14: ATTACHING BOLT (CLAMPING MEANS)
20: SUPPORTING BODY
44: COUNTER ROLL

12: FLANGE (CLAMPING MEMBER)
13: POSITIONING PIN
14: ATTACHING BOLT (CLAMPING MEANS)

10: BLANKET
25: CUTOUT
26: TONGUE PORTION
27: POSITIONING BORE

10:BLANKET
11:SUPPORTING HEAD
11a:FIRST TAPERED SURFACE

10:BLANKET
11a:FIRST TAPERED SURFACE
26:TONGUE PORTION
27:POSITIONING BORE

10: BLANKET
11a: FIRST TAPERED SURFACE
12: FLANGE (CLAMPING MEMBER)
12a: FIRST CLAMPING SURFACE
26: TONGUE PORTION
27: POSITIONING BORE

11: SUPPORTING HEAD
12: FLANGE (CLAMPING MEMBER)

10: BLANKET
11: SUPPORTING HEAD
11a: FIRST TAPERED SURFACE
12: FLANGE (CLAMPING MEMBER)
24: SEALING GROOVE

10: BLANKET
11: SUPPORTING HEAD
11a: FIRST TAPERED SURFACE
12: FLANGE (CLAMPING MEMBER)
28: O-RING

13: POSITIONING PIN
14: ATTACHING BOLT (CLAMPING MEANS)
20: SUPPORTING BODY
44: COUNTER ROLL
101: BLANKET
111: SUPPORTING HEAD
111a: FIRST TAPERED SURFACE
111b: SECOND TAPERED SURFACE
121: FLANGE (CLAMPING MEMBER)
121a: FIRST CLAMPING SURFACE
121b: SECOND CLAMPING SURFACE

13: POSITIONING PIN
14: ATTACHING BOLT (CLAMPING MEANS)
121: FLANGE (CLAMPING MEMBER)

20: SUPPORTING BODY
44: COUNTER ROLL
102: BLANKET
112: SUPPORTING HEAD
112a: FIRST TAPERED SURFACE
112b: SECOND TAPERED SURFACE
122: FLANGE (CLAMPING MEMBER)
122a: FIRST CLAMPING SURFACE
122b: SECOND CLAMPING SURFACE

13: POSITIONING PIN
14: ATTACHING BOLT (CLAMPING MEANS)
122: FLANGE (CLAMPING MEMBER)

13: POSITIONING PIN
14: ATTACHING BOLT (CLAMPING MEANS)
20: SUPPORTING BODY
44: COUNTER ROLL
103: BLANKET
113: SUPPORTING HEAD
113a: FIRST TAPERED SURFACE
113c: OUTER END SURFACE
123: FLANGE (CLAMPING MEMBER)
123a: FIRST CLAMPING SURFACE

13: POSITIONING PIN
14: ATTACHING BOLT (CLAMPING MEANS)
123: FLANGE (CLAMPING MEMBER)

13: POSITIONING PIN
14: ATTACHING BOLT (CLAMPING MEANS)
20: SUPPORTING BODY
44: COUNTER ROLL
104: BLANKET
114: SUPPORTING HEAD
114a: FIRST TAPERED SURFACE
114b: SECOND TAPERED SURFACE
124: FLANGE (CLAMPING MEMBER)
124a: FIRST CLAMPING SURFACE
124b: SECOND CLAMPING SURFACE

13: POSITIONING PIN
14: ATTACHING BOLT (CLAMPING MEANS)
124: FLANGE (CLAMPING MEMBER)

13: POSITIONING PIN
14: ATTACHING BOLT (CLAMPING MEANS)
20: SUPPORTING BODY
44: COUNTER ROLL
105: BLANKET
115: SUPPORTING HEAD
115a: FIRST TAPERED SURFACE
115b: SECOND TAPERED SURFACE
125: FLANGE (CLAMPING MEMBER)
125a: FIRST CLAMPING SURFACE
125b: SECOND CLAMPING SURFACE

13: POSITIONING PIN
14: ATTACHING BOLT (CLAMPING MEANS)
125: FLANGE (CLAMPING MEMBER)

PRESS ROLL

TECHNICAL FIELD

The present invention relates to a structure for mounting a flexible blanket on a supporting head of a press roll which is employed in a press section, calender section, etc. of a paper making machine, and which presses the flexible blanket against a counter roll to apply pressure to a web held between the flexible blanket and the counter roll.

BACKGROUND ART

A press roll, which presses a web at a nipping portion formed between the roll and a counter roll, is employed, for example, in the press section of a paper making machine to dewater the web. As shown in FIGS. 19 and 20, the structure disclosed in Japanese Patent Publication No. HEI 3-41586 is known as a conventional press roll for a papermaking machine. FIG. 19 is a vertical sectional view of the principal part of the conventional press roll, and shows a view taken in the direction of arrow H in FIG. 20.

As shown in FIG. 19, the press roll includes a counter roll 44, a supporting body 42 disposed to face the counter roll 44, and a supporting disc 31 rotatably supported by the supporting body 42. The press roll further includes a flexible blanket 30 whose end portion is mounted on the supporting disc 31, a flange 32 for clamping the blanket 30 to the supporting disc 31 in the axially inward direction of the press roll, and a sliding mechanism 51 for sliding the supporting disc 31 in the axial direction.

The supporting body 42 is disposed under the counter roll 44 and extends in the same axial direction as the counter roll 44. The axially central portion of the supporting body 42 is provided with a groove 50 in which a piston (not shown) is fitted so that it is movable in the radial direction of the supporting body 42.

Furthermore, the tip end of the piston is provided with a press shoe 43. The exterior surface of the press shoe 43 has a concave shape. The radius of curvature of the press shoe 43 is set so that a small gap is formed between the press shoe 43 and the outer peripheral surface of the large-diameter portion of the counter roll 44 facing the press shoe 43. If pressurized oil is supplied to the groove 50, the press shoe 43 is pressed through the piston against the outer peripheral surface of the counter roll 44 via the blanket 30.

Ring-shaped sleeves 46 are fitted on the axially opposite end portions (in FIG. 19, only one end is shown) of the supporting body 42 so that they are slidable in the axial direction. The blanket-supporting disc 31 is supported on the outer periphery of each sleeve 46 through a bearing 45 so that it is rotatable in the circumferential direction. A bearing pedestal 49 is mounted on one end of the supporting body 42. The sleeve 46 is slidable in the axially inward direction of the press roll by a screw 48 inserted into the bearing pedestal 49, and is also slidable in the axially outward direction by the reaction force of a spring interposed between the sleeve 46 and the supporting body 42.

The cylindrical flexible blanket 30 is mounted at its axial end portions on the blanket-supporting discs 31. The axially opposite end portions (in FIG. 19, only one end portion is shown) of the blanket 30 have tongue portions 36 of uniform length, required for mounting over the circumference of the supporting disc 31. The tip end of each tongue portion 36 is provided with a bore 37 of suitable size. The bottom portion of a cutout between two adjacent tongue portions 36 has a suitable radius of curvature. The end portion of the blanket 30 is bent at a right angle along the outer end surface of the blanket-supporting disc 31. The blanket 30 is positioned by bushes 41 and pins 33, 38 provided in the outer end surface of the blanket-supporting disc 31 and is clamped by a clamping flange 32 and mounting bolts 34 (details of the mounting method will be described later). Therefore, in combination with an O-ring 40 provided in the axially outer end surface of the blanket-supporting disc 31, lubricating oil between the concave area of the press shoe 43 and the inner surface of the blanket 30 is prevented from leaking to the outside. In the state in which the blanket 30 is rotatably supported by the supporting body 42, the blanket 30 is moved in the axially outward direction by applying a suitable force to the sleeve 46 with spring 47.

In this state, if the counter roll 44 is rotated by a drive unit (not shown), the blanket 30 rotates while being lubricated along the concave surface of the press shoe 43.

In the press roll for dewatering a web, if an endless rotating felt and a web are inserted between the blanket 30 and the counter roll 44, the web is pressed against the press shoe 43 and therefore moisture in the web is transferred to the felt. As a result, the web is dewatered. The dewatered web is separated from the felt and moved to the dryer section, the calender section and the reel section.

As described above, the blanket 30 is inserted between the press shoe 43 and the counter roll 44 during operation and repeatedly undergoes bending, stretching, and compression. Because of this, the blanket 30 is liable to be damaged, and must be frequently exchanged in a relatively short period.

However, when exchanging the blanket 30, the press roll has to be stopped. Therefore, in order to obtain a high rate of operation, it is necessary to reduce the number of exchanges of the blanket 30 and to exchange the blanket 30 in a short time.

Next, based on the aforementioned Japanese Patent Publication No. HEI 3-41586, a description will be given of how a new blanket 30 is mounted on the blanket-supporting disc 31 when the conventional blanket 30 is exchanged.

FIG. 20 is a diagram (taken in the direction of arrow G in FIG. 19) showing the state in which the conventional blanket 30 is mounted on the blanket-supporting disc 31. In the outer end surface of the supporting disc 31, the bushes 41 and pins 38 corresponding in number to the cutouts 35 are disposed at equal intervals on a concentric circle smaller than the outside diameter of the supporting disc 31. On an even smaller concentric circle, the pins 33, equal in number to the tongue portions 36, are disposed at equal intervals.

When a new blanket 30 is mounted on the supporting disc 31, the screw 48 is first tightened to move the sleeve 46 and the supporting disc 31 in the axially inward direction. Then, as shown in FIG. 19, the end portion of the blanket 30 is bent at a right angle to bring the bottom portions 35*a* of the cutouts 35 into contact with the bushes 41 and the pins 38. At the same time, the bores 37 of the tongue portions 36 are fitted on the pins 33 to perform positioning of the end portion of the blanket 30.

A sequence of these operations is performed on all of the tongue portions 36 of both ends of the blanket 30. Thereafter, as shown in FIG. 19, the blanket 30 is fixed to the supporting disc 31 by clamping the clamping flange 32 with the mounting bolts 34. Finally, the screw 48 is loosened to move the supporting disc 31 in the axially outward direction. In this way, all operations are completed.

If the blanket 30 has a twist when it is mounted on the supporting disc 31, or the blanket 30 is eccentrically mounted on the supporting disc 31, good rotation cannot be obtained during operation and the quality of the web will degrade. Therefore, the blanket 30 must be stretched uniformly and mounted on the supporting disc 31 without eccentricity. Because of this, in the state in which phases in the direction of rotation coincide at both ends of the blanket 30 (a state in which there is no twist with respect to the axis of rotation), the blanket 30 needs to be mounted on the supporting disc 31 without eccentricity. Hence, the bores 37 of the tongue portions 36 of both ends of the blanket 30 need to be fitted on predetermined pins 33.

However, even if the bores 37 are fitted on the pins 33 at correct positions, a twist will occur partially in the blanket 30 if some of the tongue portions 36 of the blanket 30 are positioned in directions inclined from the radial direction of the supporting disc 31. In the partially twisted state, if the blanket 30 is fixed with the clamping flange 32 and is stretched in the axially outward direction, undulations will occur in the blanket 30. For this reason, the tongue portions 36 need to be positioned with respect to the supporting disc 31 without being inclined before the clamping flange 32 is clamped.

In this conventional method, the bottom portions 35*a* of the cutouts 35 are merely brought into contact with some of the bushes 41 and pins 38. Therefore, if the length from the bore 37 of the tip end of the tongue portion 36 to the center of curvature of the bottom portion 35*a* of the cutout 35 is longer than the distance between the pin 33 and the bush 41 (or the pin 38), there is a possibility that the bottom portion 35*a* of the cutout 35 cannot abut the bush and therefore the tongue portion 36 will incline. Because of this, the length from the bore 37 of the tip end of the tongue portion 36 to the center of curvature of the bottom portion 35*a* of the cutout 35 is made shorter than the distance between the pin 33 and the bush 41 (or the pin 38), and the tongue portions 36 are tensioned and attached to the supporting disc 31.

In a sequence of operations of tensioning the tongue portions 36 and fixing the blanket 30, as shown in FIG. 21, a tool 39 is first passed through the bore 37 of the tongue portion 36 and connected to the pin 33.

Then, the tool 39 is rotated toward the center axis of the supporting disc 31 to bring the bottom portion 35*a* of the cutouts 35 into contact with the bush 41 and the pin 38. The tongue portion 36 is further pulled toward the center axis, and at the same time, the bore 37 of the tongue portion 36 is fitted on the pin 33. Thus, the mounting of the blanket 30 requires much labor and time.

Furthermore, to form a clamping portion and a sealing portion in the radially outer portion of the end surface of the blanket-supporting disc 31, the blanket end portion devoid of cutouts is pulled up to the clamping and sealing portion, and in this state, the bores 37 of the tongue portions 36 are fitted on the pins 33. Therefore, that portion of the blanket where clamping and sealing are formed must be compressed in the circumferential direction. However, with the tongue portion 36 fixed by the pin 33, the blanket has an undulated portion between the root of the tongue portions 36. If the tongue portions 36 are fixed by the pins 33 over the blanket circumference, the pitch between the undulated portions becomes shorter. Therefore, the operation of forming undulated portions in the blanket end portion and also tensioning the tongue portions 36 and fixing the tensioned tongue portions 36 to the pins 33 requires much labor. This labor will be lessened if the roll diameter becomes greater. However, in the case where the roll diameter is small, the above-described operation is fairly difficult. The blanket is clamped and sealed when the undulated blanket end portion is forcibly deformed into a flat shape by clamping the clamping flange 32 to the supporting disc 31 with the mounting bolts. Because of this, residual stress occurs in the undulated portion and the blanket-mounting operation is not efficient.

The inner circumferential length of the blanket is made longer than the outer circumferential length of the supporting disk 31 to enhance the operation efficiency at the time of the blanket insertion. Because of this, even if the blanket is positioned at the tongue portions of the opposite end portions by employing the pins 33, bushes 41, and pins 38, the blanket hangs down below the blanket-supporting disc 31 by the flexibility and weight of the blanket itself. Therefore, even if the blanket is correctly positioned in the axial direction at the tongue portions, the blanket portion from the root of the tongue portion to the outer periphery of the supporting disk has already been twisted. That is, the centering of the blanket is insufficient. To avoid this problem, only an end portion of the blanket mounted on the outer periphery of the supporting disc without strain is loosely clamped at the uppermost portion of the roll. Thereafter, the blanket is rotated through about 180 degrees to move the lowermost portion to the uppermost portion. Next, only a blanket end portion correctly mounted on the outer periphery of the supporting disc is loosely clamped. After a sequence of these operations is repeated and temporal clamping is performed over the circumference, the blanket must be tightly clamped over the circumference. Furthermore, the clamping operation must be performed on both end portions of the blanket. Because of this, the clamping operation requires labor and time, and is not efficient.

The present invention has been made in view of the above-described problems. Accordingly, it is the object of the present invention to provide a press roll that has a high rate of operation, being capable of easily exchanging a flexible blanket in a short time.

DISCLOSURE OF THE INVENTION

To achieve the above-described object, there is provided a press roll forming a nipping portion along with a counter roll. The press roll includes a cylindrical blanket having flexibility and sealed to prevent fluid leakage, and a supporting body disposed within the blanket in an axial direction. The press roll also includes supporting heads, clamping members, and clamping means. The supporting heads are rotatably supported at both ends of the press roll and outside the nipping portion by the supporting body, and are used to support the inner peripheral surfaces of both end portions of the blanket. The clamping members are disposed outside the supporting heads, and are used to clamp the end portions of the blanket to the supporting heads. The clamping means are used for clamping the clamping members to the supporting heads through the blanket. The press roll further includes a first tapered surface and a first clamping surface. The first tapered surface is formed in the outer peripheral surface of each of the supporting heads, and diminishes in outside diameter toward its axially outer end. The first clamping surface is formed in the inner peripheral surface of each of the clamping members, and coincides with the first tapered surface. The blanket is clamped on the first tapered surface in a perpendicular direction by the first clamping surface and the first tapered surface.

In the case where the blanket end portion is bent along the outer peripheral surface of the supporting head, the tip end of the bent blanket becomes smaller in diameter than the bent portion and therefore a difference in circumferential length occurs. That is, in the case where the blanket is completely fitted on the supporting head, the blanket tip end must be contracted. When this condition is not met, an undulation occurs in the blanket tip end.

However, in the present invention, the outer peripheral surface of the supporting head has a first tapered surface that diminishes in outside diameter toward its axial outer end. Therefore, the quantity of contraction of the end portion required for fitting on the supporting head is reduced compared with the case where the end portion is bent at a right angle along a supporting head having no tapered surface. As a result, undulation that occurs in the blanket end portion is lessened. Therefore, the blanket is mounted without strain, and the efficiency of the blanket-mounting operation is enhanced.

To make insertion of the blanket easier, the inner circumferential length of the blanket is made longer than the maximum outer peripheral length of the blanket-supporting head. If the blanket is clamped so that the clamping member is fitted on the supporting head at the first tapered surface, slack in the blanket is taken up by the tapered surface of the clamping member when the clamping member is clamped. As a result, this slack is distributed uniformly over the circumference, and the circumferential length is compressed along the first tapered surface. Therefore, if the blanket is clamped with the clamping member, the centering of the blanket is automatically performed uniformly over the circumference.

The end portions of the blanket may be provided with a plurality of cutouts at equal intervals, and between the cutouts adjacent to each other, there may be formed a tongue portion. In this case, undulation that occurs in the blanket end portion can be lessened. When the blanket end portion is bent along the first tapered surface, the total circumferential length of the tip ends of the tongue portions becomes shorter and the quantity of contraction required for the blanket end portion to be fitted on the first tapered surface is further reduced. In addition, the number of tongue portions can be reduced compared with the case where the end portion is bent at a right angle.

The axial end surface of the supporting head may be provided with a conical recess which forms a second tapered surface continuous to the first tapered surface. The clamping member may be provided with a second clamping surface which coincides with the second tapered surface. In this case, clamping is performed on the first clamping surface and the first tapered surface by the clamping member. Furthermore, the second clamping surface is pressed against the second tapered surface. As a result, the stability of the clamping is increased.

The first tapered surface and the second tapered surface of a conical recess, formed in the exterior surface of each of the supporting heads, may be connected together through a curved surface. At least a portion of the tongue portion of the end portion of the blanket may be extended to the second clamping surface and may be clamped by the second tapered surface and the second clamping surface. That is, the tongue portions of the end portion of the blanket may be wound in contact with the supporting head. In this case, the clamping of the blanket end portion becomes more solid.

The first tapered surface of the outer periphery of the supporting head may be provided with pins for positioning the blanket, and the blanket end portion may be provided with bores which are fitted on the positioning pins. In this case, the positioning of the blanket can be quickly performed and operational efficiency is enhanced. In addition, if positioning pins are provided in the outer end surface of the supporting head, the structure for avoiding interference with the positioning pins on the first tapered surface becomes unnecessary. As a result, the axial length of the first tapered surface of the supporting head can be shortened and the clamping member can be made structurally simpler. Furthermore, the weight of the clamping member can be reduced. Because of this, handling becomes easy and operational efficiency is further enhanced.

The clamping member may be divided into a plurality of segments. In this case, handling becomes easy. In the case where the clamping member is pressed against the first tapered surface on the outer peripheral side of the supporting head and against the second tapered surface of the recess on the inner peripheral side of the supporting head, the clamping member undergoes a reaction force from the sealed surface of the blanket at first tapered surface on the outer peripheral side and also undergoes a reaction force from the second tapered surface of the recess on the inner peripheral side. Since the two moments of rotation are applied in opposite directions, they cancel each other out. Thus, the clamping member becomes stable.

The first tapered surface on the outer peripheral side of the supporting head may be provided with a sealing groove to enhance sealing performance. In addition, a sealing material, such as an O-ring, a lip seal, etc., may be fitted in the groove.

The outer peripheral surface of the supporting heads may be provided with an inner tapered surface which diminishes in outside diameter toward its axially inner end. According to this, the blanket-mounting operation can be more easily performed.

In the press roll constructed as described above, when a blanket is mounted on the supporting head, the blanket end portion is first bent along the first tapered surface of the supporting head. Then, the blanket end portion is positioned with respect to the supporting head. Next, the blanket end portion is clamped in the radially inward direction and axially inward direction of the supporting body with the clamping member. In this way, the blanket end portion is clamped to the supporting head at the first tapered surface of the supporting head along the tapered shape of the first clamping surface.

BRIEF DESCRIPTION OF THE DRAWINGS

FIG. 4(*b*) is a schematic diagram showing the sealing portion of the blanket end portion of the press roll of the present invention;

FIG. 8(*b*) is a diagram showing another sealing structure formed in the supporting head, an O-ring being provided in the first tapered surface of the supporting head in the circumferential direction;

BEST MODE FOR CARRYING OUT THE INVENTION

Embodiments of the present invention will hereinafter be described in detail with reference to the drawings.

Figure 1:
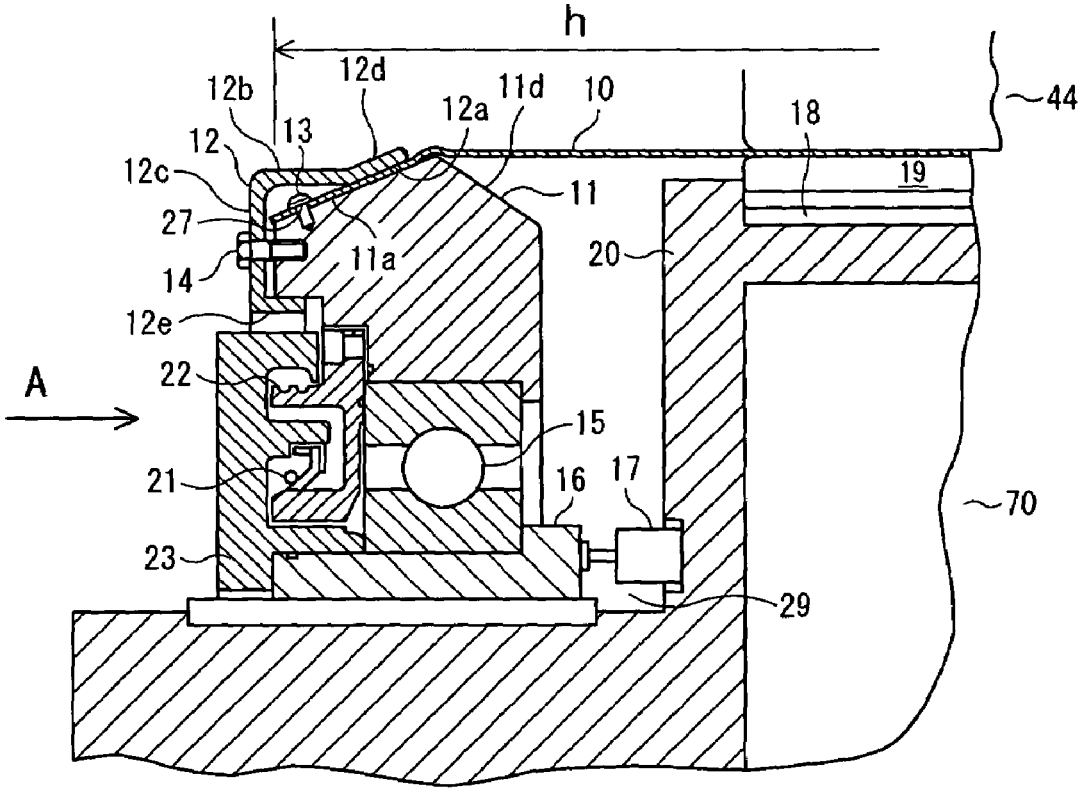
FIG. 1 is a vertical sectional view showing the principal part of a press roll constructed in accordance with one embodiment of the present invention.
Figure 2:
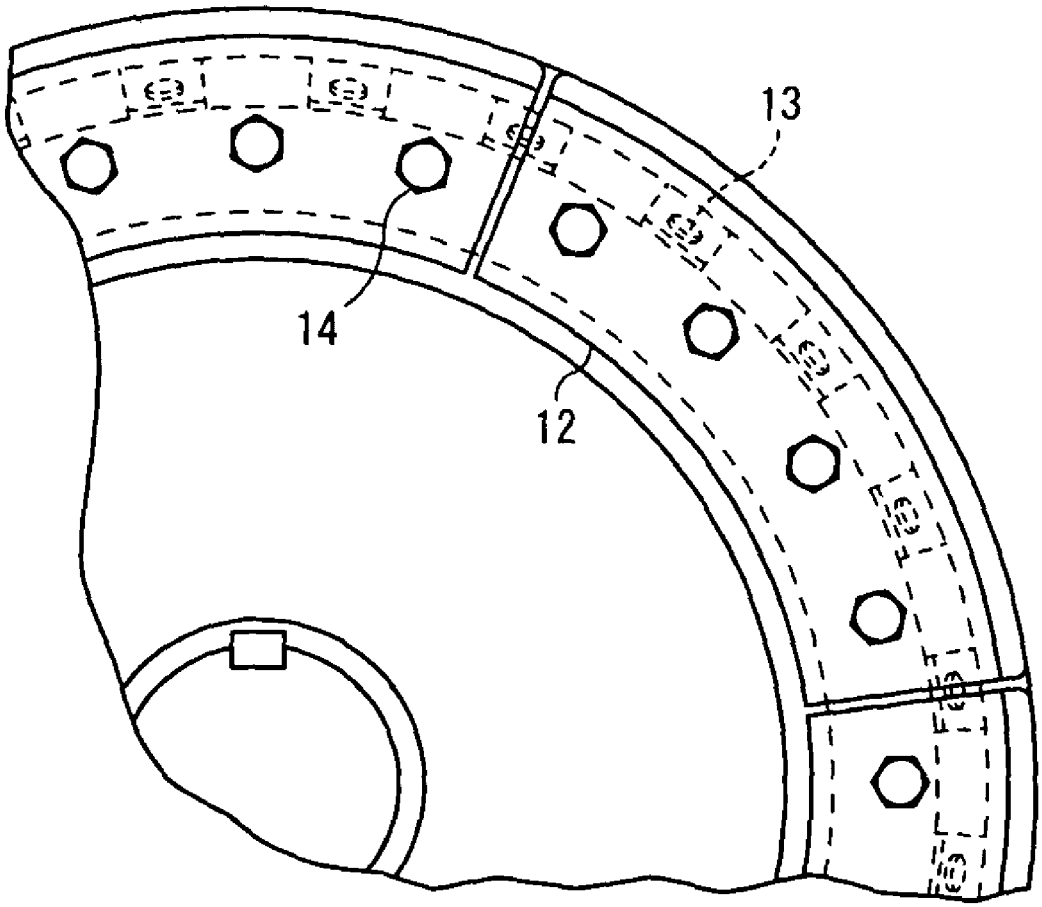
FIG. 2 is a view, taken in the direction of arrow A of FIG. 1, showing part of the supporting head of the press roll constructed in accordance with the one embodiment of the present invention.
Figure 3:
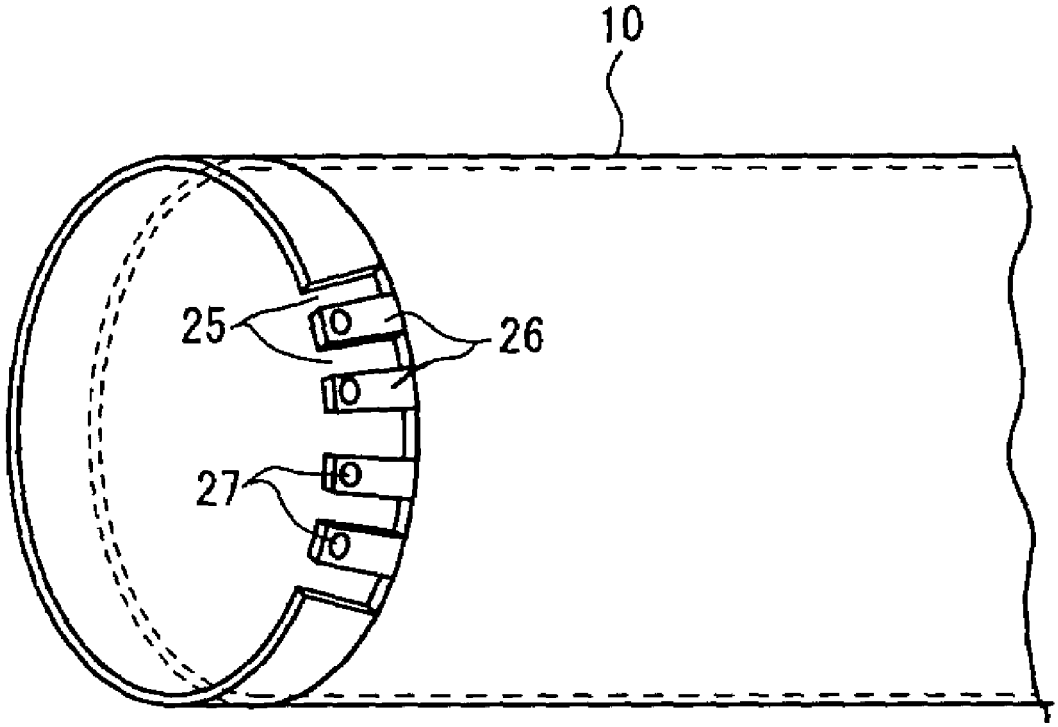
FIG. 3 is a perspective view showing the end portion of the blanket of the press roll constructed in accordance with the one embodiment of the present invention.
Figure 4A:
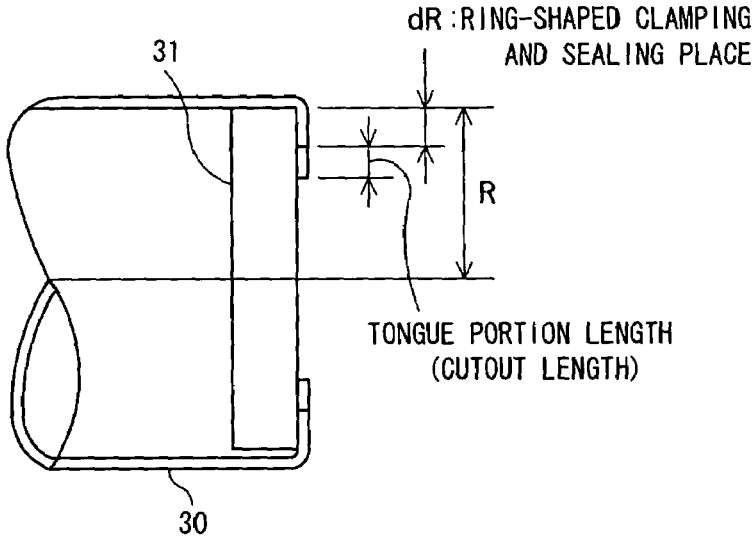
FIG. 4(*a*) is a schematic diagram showing the sealing portion of the blanket end portion of a conventional press roll.
Figure 4B:
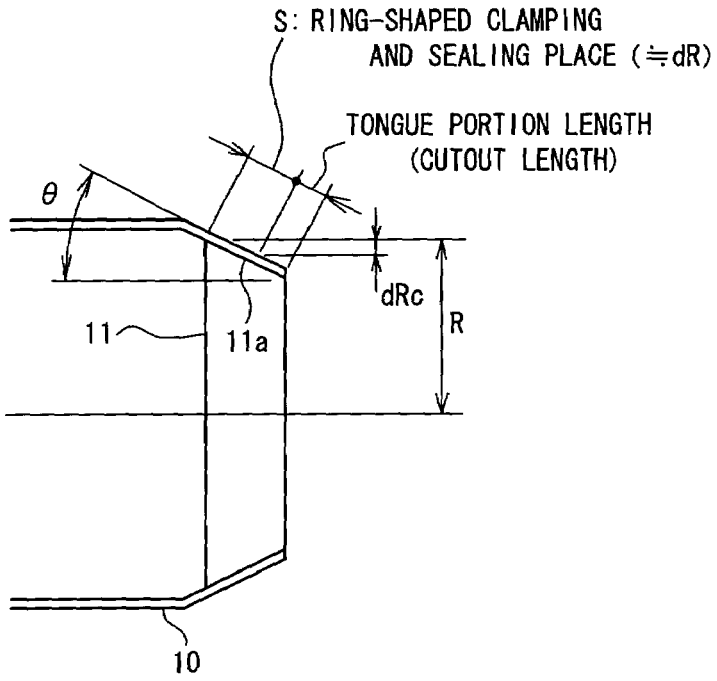
Figure 5:
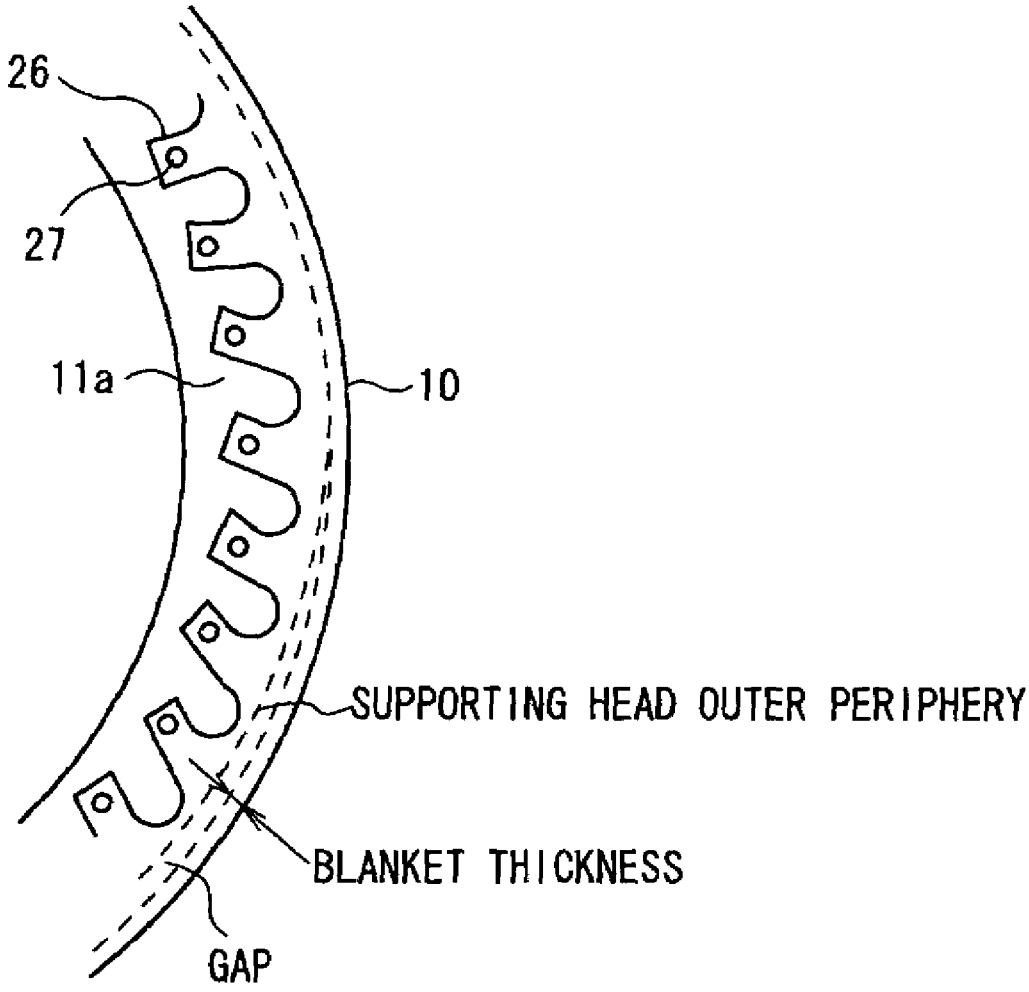
FIG. 5 is an explanatory diagram showing slack in the blanket end portion mounted on the supporting head by pins.
Figure 6:
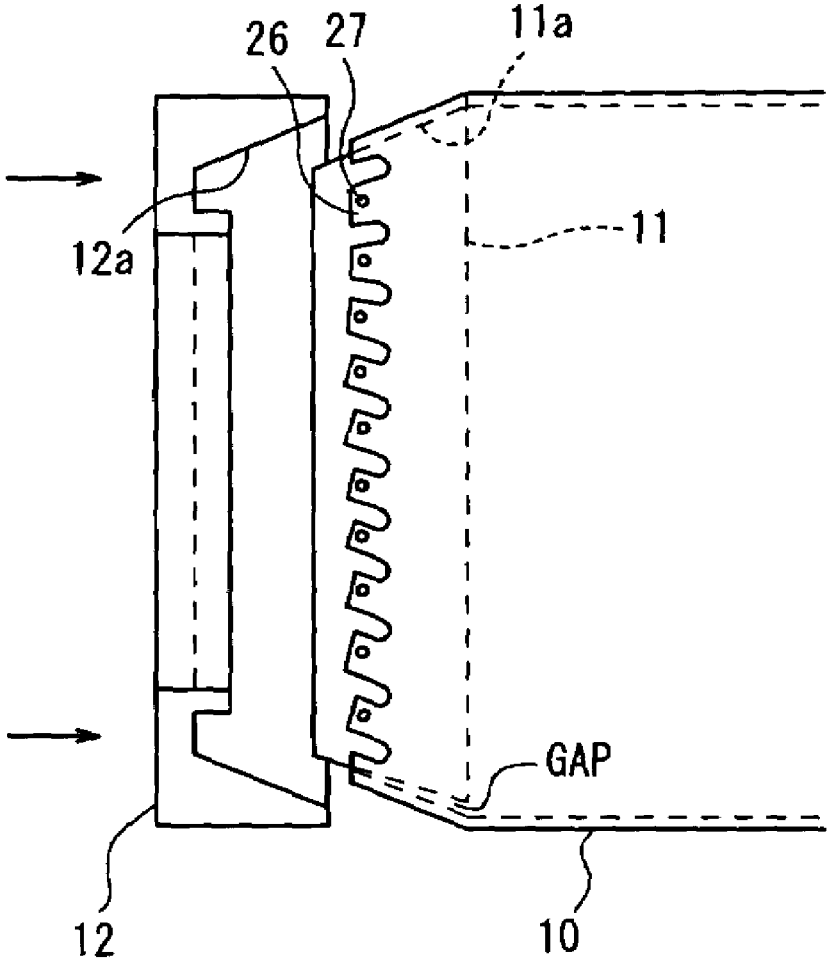
FIG. 6 is a diagram showing how the blanket mounted on the supporting head of the press roll of the one embodiment of the present invention is clamped by a flange.

FIG. 1 is a vertical sectional view of the principal part of a press roll in one embodiment of the present invention; FIG. 2 is a view, taken in the direction of arrow A of FIG. 1, showing a flexible blanket mounted on a supporting head; and FIG. 3 is a perspective view of the end portion of the blanket. FIGS. 4(*a*) and 4(*b*) are diagrams showing the comparison of the sealing portions formed by the blanket and the supporting head in accordance with prior art and the present invention; FIG. 5 is an explanatory diagram showing slack in the blanket end portion mounted on the supporting head by pins; and FIG. 6 is a diagram showing how the blanket mounted on the supporting head by pins is clamped by a flange. FIGS. 9 through 18 are diagrams showing other embodiments, and FIGS. 8(*a*) and 8(*b*) are diagrams showing various sealing structures formed in the supporting head.

As shown in FIG. 1, the principal part of the press roll in the present invention is constructed of a counter roll 44, a supporting body 20 disposed within a press roll 70, a supporting head 11 rotatably supported by the supporting body 20, a flexible blanket 10 whose opposite end portions are mounted on the supporting heads 11, a flange (clamping member) 12 for clamping the blanket 10 to the supporting heads 11 in the axially inward direction of the press roll 70, and a sliding mechanism 29 for sliding the supporting head 11 in the axial direction.

The axially central portion of the supporting body 20 has a groove 18 in which a piston (not shown) is fitted so as to be movable in the radial direction of the supporting body 20. With this piston, the blanket 10 is pressed against the outer peripheral surface of the counter roll 44 through a press shoe 19. Because the structure for dehydrating a web is well known in the prior art, a description of the structure and operation is omitted.

The sliding mechanism 29 includes a ring-shaped sleeve 16 axially slidably fitted on both ends of the supporting body 20 (in FIG. 1, only one end is shown), and a hydraulic cylinder 17 attached to the supporting body 20. The sleeve 16 is axially moved by supplying oil pressure to the hydraulic cylinder 17.

The supporting head 11 is supported on the sleeve 16 through a bearing 15 so that it is rotatable in the circumferential direction. The outer race of the bearing 15 is clamped by the supporting head 11 and an annular bearing presser block 22 attached to the axially outer surface of the supporting head 11, while the inner race is clamped by the sleeve 16 and an annular cover 23 attached to the axially outside face of the sleeve 16. The cover 23 is attached to cover the axially outer surface of the bearing presser block 22, and between the cover 23 and the bearing presser block 22 there is provided an oil seal 21 to prevent fluid leakage.

The supporting head 11 is formed so that the maximum diameter of the outer peripheral surface becomes slightly smaller than the inside diameter of the blanket 10. The outer peripheral surface of the supporting head 11 also has a tapered surface 11*a* that diminishes in thickness from the maximum diameter to the axially outer end. The tapered surface 11*a* is provided with positioning pins 13 at equal intervals. In the case where the end portion of the blanket 10 is bent along the tapered surface 11*a*, the tip end of the blanket 10 diminishes in circumferential length and must contract. In the case where the tip end of the blanket 10 does not contract, undulation occurs in the tip end of the blanket 10. Since the outer peripheral surface of the supporting head 11 has the tapered surface 11*a* that diminishes in outer diameter toward the axially outer end, the quantity of contraction of the end portion of the blanket 10 required to be fitted on the supporting head 11 is reduced compared with the case where the end portion of the blanket is bent at a right angle along a conventional cylindrical supporting head. As a result, undulation that occurs in the end portion of the blanket 10 is lessened. In addition, the outer peripheral surface on the axially inner side of the supporting head 11 is provided with an inner tapered surface 11*d* which diminishes in outer diameter toward its axially inner end. The inner tapered surface 11*d* is continuous to the first tapered surface 11*a*.

The blanket 10, as shown in FIG. 3, is cylindrical in shape, and the axially opposite ends (in FIG. 3, only one end is shown) have tongue portions 26 that are uniform in length over the circumference. Between adjacent tongue portions 26, there is provided a cutout 25. The shape of the tongue portions 26 is not limited to a trapezoid, but may be rectangular, a triangle, etc. Similarly, the cutout 25 is not limited to a flat-bottomed shape shown in FIG. 3 if it has shape that can lessen undulation in the end portion of the blanket 10, but may have a suitable radius of curvature.

Each tongue portion 26 is provided with a bore 27 for positioning the end portion of the blanket 10. The number of positioning pins 13 corresponds to the number of positioning bores 27. If the pins 13 provided in the supporting head are fitted in the positioning bores 27, the end portion of the blanket 10 can be quickly positioned and the end portion of the blanket 10 can be fixed at the time of the positioning. To prevent disengagement of the positioning pins 13 from the positioning bores 27 of tongue portions 26, each positioning pin 13 preferably has a shaft portion and a head portion greater in diameter than the shaft portion, such as those disclosed in Japanese Patent Application No. 2000-106109.

The flange 12 is disposed in front of the axially outer surface of the supporting head 11. The flange 12 is constructed of a conical clamping portion 12*d* for clamping the blanket 10 to the supporting head 11, an annular attaching portion 12*c* for being attached to the supporting head 11, a cylindrical connection portion 12*b* for connecting the clamping portion 12*d* and the attaching portion 12*c* together, and an inner guide portion 12*e*. The clamping surface (first clamping surface) 12*a* of the clamping portion 12*d* has a shape which coincides with the shape of the tapered surface (first tapered surface) 11*a* of the supporting head 11. If the attaching portion 12*c* of the clamping flange 12 is clamped with attaching bolts (clamping means) 14, the outer tapered surface 11*a* of the supporting head 11 and the clamping surface 12*a* of the flange 12 are clamped together and the blanket 10 is clamped by the wedge effect between the supporting head 11 and the clamping flange 12. As a result, the blanket 10 is fixed while fluid leakage is being prevented. To make the prevention of fluid leakage sure, the outer tapered surface 11*a* of the supporting head 11 may be provided with annular seal grooves 24 or an O-ring 28 (see e.g. FIGS. 8(*a*) and 8(*b*)). In addition, the flange 12 may be divided into a plurality of segments in the circumferential direction to make handling easy. In the case of a division type, a wedge effect is exhibited by the guide portion 12*e* and the first clamping surface 12*a*.

Next, a method of mounting a new blanket 10 on the supporting heads 11 when exchanging the blanket 10 of this embodiment, shown in FIGS. 1 to 3, will be described with reference to FIGS. 1 and 2.

In mounting a new blanket 10 on the supporting heads 11, the hydraulic cylinders 17 are first retracted to move the supporting heads 11 axially inward and to shorten the distance h between the end surfaces of the supporting heads 11.

Next, the blanket 10 is pulled around the supporting body 20 and the supporting heads 11. The end portions of the blanket 10 are bent along the tapered surface 11*a* of the supporting heads 11, and the positioning bores 27 of the tongue portions 26 are fitted on the positioning pins 13, respectively. At this time, the pulling of the blanket 10 is facilitated because the inner tapered surface 11*d*, continuous to the outer tapered surface 11*a*, diminishes in outer diameter toward the axially inner end. Since the positioning pin 13 is constructed of a shaft portion and a head portion greater in diameter than the shaft portion, there is no possibility that the end portions of the blanket 10 will be disengaged from the positioning pins 13, even if the tongue portions 26 are not pressed down until the blanket end portions are fixed with the clamping flanges 12.

After a sequence of these operations is performed on all of the tongue portions 26 of both ends of the blanket 10, the clamping flanges 12 are clamped uniformly over the circumference with the attaching bolts 14 to fix the blanket 10 to the supporting heads 11. Generally, the inner circumferential length of the blanket 10 is made slightly longer than the outer circumferential length of the supporting head 11 to facilitate the blanket-mounting operation. If the blanket 10 is mounted on the supporting heads 11 with pins, the blanket 10 slacks, and a gap occurs between the blanket 10 and the lower portion of the supporting head 11, as shown in FIGS. 5 and 6. However, when clamping is performed with the flange 12, a slack portion in the blanket 10 is pulled up along the tapered surface of the flange 12. The pulled slack portion contacts the tapered portion of the supporting head 11 and is taken up in the center direction of the supporting head 11 and in the axially inward direction of the press roll. Thus, as the flange 12 is gradually clamped, a slack portion in the blanket 10 is dispersed automatically in the circumferential direction and then it is compressed in the circumferential direction. At the time of the completion of clamping, the blanket 10 is accurately centered and mounted on the supporting head 11.

Finally, the hydraulic cylinder 17 applies a suitable force to the sleeve 16 to move the blanket 10 in the axially outward direction, and all operations are completed.

Since the press roll in the one embodiment of the present invention is constructed as described above, it possesses the following advantages:

I. Regarding Blanket-Mounting Strain and Blanket-Mounting Operation of the Blanket 10

The blanket-mounting strain and blanket-mounting operation in the conventional press roll shown in FIG. 19, and the blanket-mounting strain and blanket-mounting operation in the press roll of the present invention shown in FIG. 1, will be described with reference to FIGS. 4(*a*) and 4(*b*), respectively.

In the conventional press roll shown in FIG. 4(*a*), the inner circumferential length L of the blanket 30 is expressed by the following equation:

$$L=2\pi R$$

where 2R represents the inside diameter of the blanket 30 when it is a true circle.

The inner circumferential length L' of the blanket end on the ring-shaped clamping surface is expressed as $$L'=2\pi(R-dR)$$

Therefore, if the blanket 30 does not shrink by 2πdR, the blanket 30 is not accurately fitted on the end surface of the blanket-supporting disc 31.

In the state in which the end portion of the blanket 30 is bent toward the center axis thereof and temporarily fixed with pins 33, an excess in the blanket circumferential length forms undulation from the blanket circumference (which is the roots of the tongue portions 36 of the end portion of the blanket 30) toward the direction of the outside diameter.

A ratio of an excess in the circumferential length to the inner circumferential length is expressed as $$(L-L')/L=dR/R$$

The length dR required for the clamping and sealing of the blanket 30 is approximately constant regardless of the diameter 2R of the roll. In the case where the roll diameter 2R is great, there is no problem. However, when it is small, it is difficult to press the clamping flange 32 against undulations in the blanket 30 to make the blanket 30 flat and to fit the blanket 30 onto the end surfaces of the blanket-supporting discs 31. Thus, it is difficult to temporarily fix the tongue portions 36 of the end portions of the blanket 30 with pins 33.

On the other hand, in the case of the press roll of the present invention shown in FIG. 4(*b*), if the end portions of the blanket 10 are the same as the conventional blanket 30, the length S required for the clamping and sealing of the blanket 10 is approximately the same as dR. However, since the outer peripheral surface of the supporting head 11 has a conical form (the tapered surface 11*a*), the radial length dRc of the length S is expressed as $$dRc=S\cdot\sin\theta\approx dR\cdot\sin\theta$$

Therefore, if the blanket 10 shrinks by $2\pi dR\cdot\sin\theta$, it can be accurately fitted on a conical surface (the tapered surface 11*a*) of the supporting head 11. Therefore, if the inner circumferential length of the blanket end on the ring-shaped clamping surface is represented by Lc', a ratio to the inner circumferential length of the blanket 10 is expressed as $$(L-Lc')/L=dR\cdot\sin\theta/R$$

Therefore, if θ is set to a small angle, undulations in the blanket described in the prior art are reduced and therefore the blanket 10 can be mounted on the supporting heads 11 without strain. Therefore, operation in mounting the end portions of the blanket 10 on the supporting heads 11 is efficient. The number of tongue portions 26 can be increased to reduce the quantity of undulations in the blanket 10. In the press roll of the present invention, the number of tongue portions 26 required for the allowable amount of the same undulation can be reduced compared with the conventional press roll. Therefore, the number of bolts 14 required for clamping the blanket can also be reduced. Thus, operation in clamping the blanket 10 becomes easy.

II. Centering and Mounting of the Blanket 10

The inner circumferential length of the blanket 10 is made longer than the outer circumferential length of the supporting head 11 to facilitate insertion. In addition, the blanket 10 has flexibility. Therefore, even if the blanket 10 is accurately positioned at the pins 13 in the axial direction in a temporarily clamped state in which the bores 27 are fitted on the pins 13, the tongue portions 26 are inclined with respect to the radial direction of the blanket 10 at positions other than the positions right above and right under the roll by the weight of the blanket itself, as shown in FIG. 5 (shown).

Figure 19:
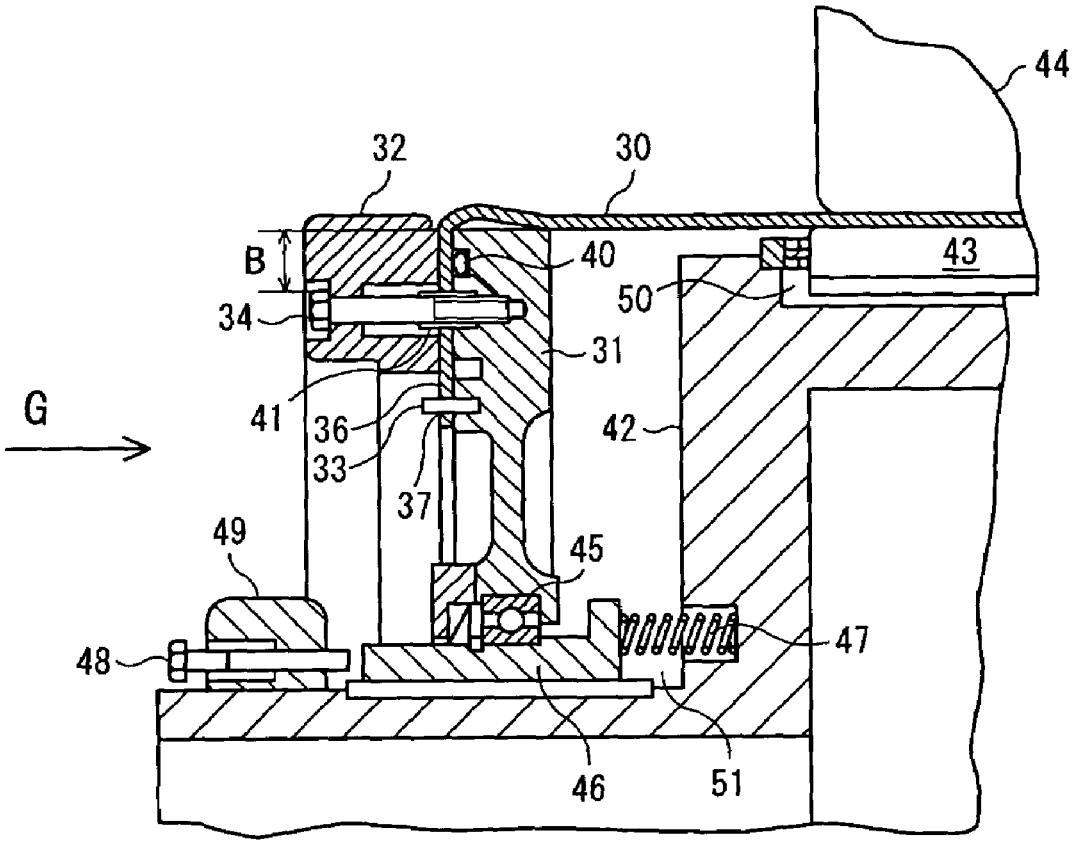
FIG. 19 is a view similar to FIG. 1 showing a conventional press roll.
Figure 20:
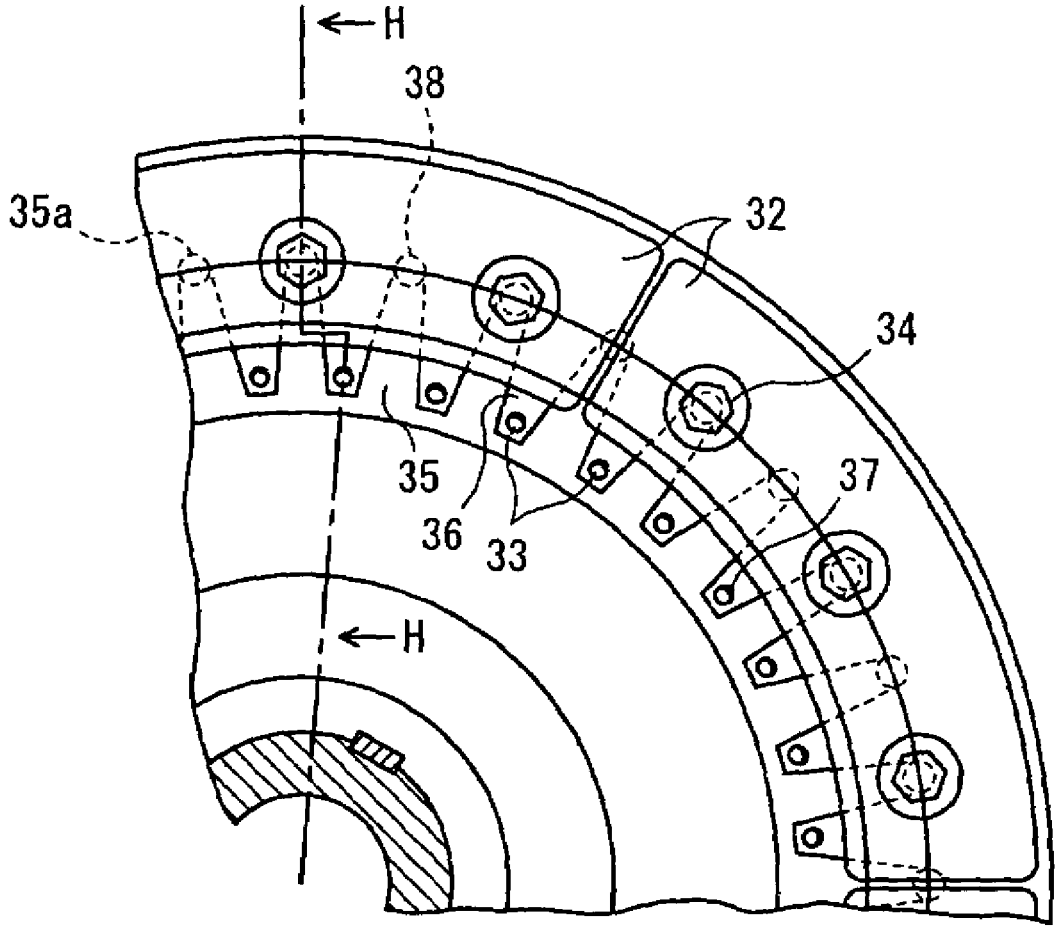
FIG. 20 is a view, taken in the direction of arrow G of FIG. 19, showing the supporting head of the conventional press roll.
Figure 21:
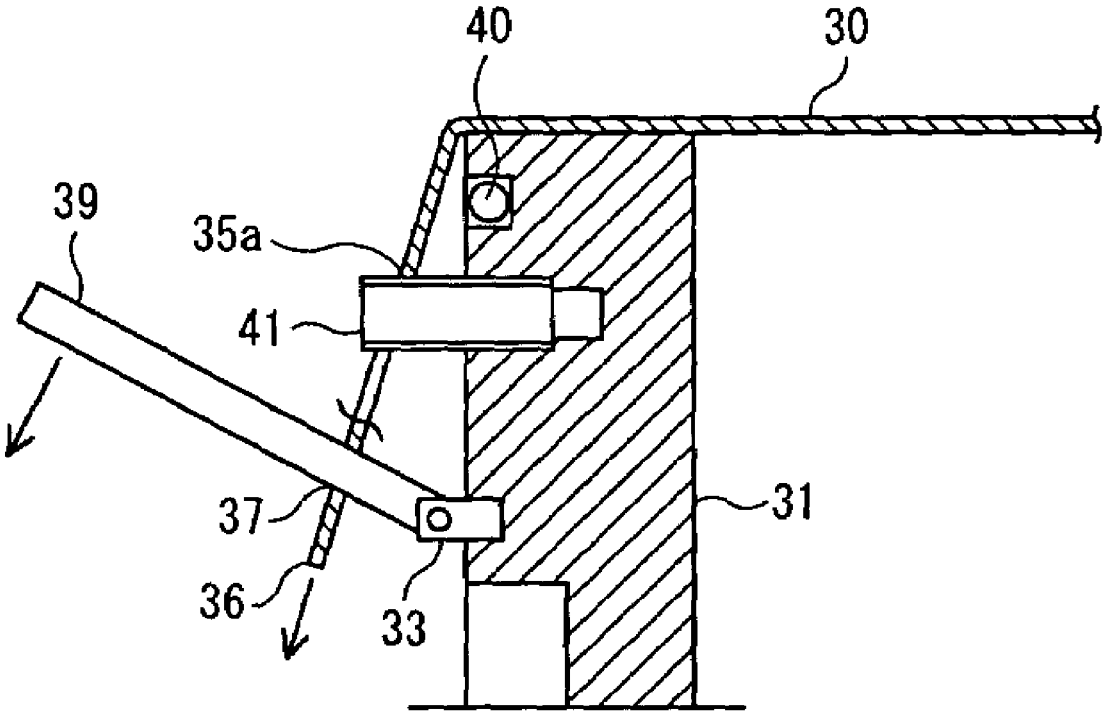
FIG. 21 is a diagram showing a conventional blanket-mounting method.

To correct for this, the conventional press roll has guide pins 38 between tongue portions 36, as shown in FIGS. 19 and 20. However, these pins are used to regulate positioning elements, and if clamping is not performed outside the positioning elements, sealing for preventing oil leakage from the interior cannot be performed. As a result, the centering of the blanket 30 becomes insufficient.

If the press roll 70 is operated at high speed when the centering of the blanket 30 is insufficient, the blanket repeatedly presses an endless felt at an input side of a nipping portion because of eccentricity each time it makes one revolution. This interferes with operation of the press roll 70. This phenomenon is called "wobbling." To minimize the wobbling, only a portion of the end portion of the blanket 30 mounted on the outer peripheral surface of the blanket-supporting disc 31 without strain is clamped at the uppermost portion of the roll. Thereafter, the blanket 30 is rotated through about 180 degrees to move the lowermost portion to the uppermost portion. In this way, the operation of clamping only a portion of the end portion of the blanket 30 mounted correctly on the outer peripheral surface of the blanket-supporting disc 31 is repeated. Furthermore, this operation must be performed while clamping both end portions of the blanket 30. Therefore, the clamping operation is time-consuming, and is not efficient.

On the other hand, in the press roll of the present invention shown in FIG. 1, the end portion of the blanket 10 is clamped on the supporting head 11 having a truncated conical shaped tapered surface 11*a* on the outer peripheral surface by the conical shaped (tapered) clamping surface 12*a* of the flange 12. Therefore, in the state in which the tongue portions 26 of the end portion of the blanket 10 are temporarily clamped with the pins 13, as shown in FIG. 6, the blanket 10 is positioned at the pins 13 in the same way as the prior art. However, there is undulation between the pins 13, although it is reduced by the amount of sin theta. In addition, at the lowermost portion of the roll, the blanket 10 hangs down below the supporting head 11.

In this state, if the flange 12 is gradually clamped to the supporting head 11, the blanket 10 first contacts the flange 12 at the lowermost portion of the supporting head 11. With the taper of the clamping surface 12*a*, the blanket 10 is pulled in the direction normal to the inclined surface of the flange 12, that is, toward the roll center. At the same time, the blanket 10 hanging down below the supporting head 11 is pushed away in the right and left directions slightly upward from the lowermost portion.

If the flange 12 is further clamped, the tapered surface 12*a* of the the flange 12 contacts a portion of the blanket 10 where slack has been pushed away in the right and left directions slightly upward from the lowermost portion of the supporting head 11, and stretches this portion toward the roll center. In this way, slack in the blanket 10 at the lower portion of the supporting head 11 is pushed away in the right and left directions slightly upward from the lowermost portion of the supporting head 11 as the flange 12 is gradually clamped. The slack is taken up by being distributed over the circumference of the blanket 10 and also being stretched toward the roll center. Subsequently, the blanket 10 is compressed in the circumferential direction. Therefore, the blanket 10 is centered by clamping the flange 12. Such a self-aligning operation is performed over the whole surface of the tapered flange 12. Therefore, the blanket 10 is clamped uniformly over the circumference while it is being centered. Even in the case where the flange 10 is not formed as one object over all of the circumference, but is divided into a plurality of segments to make handling easy, the same advantages are obtained if all of the segments are gradually clamped approximately uniformly as described above.

Such a self-aligning operation does not occur in the conventional press roll where a flange 32 with a clamping surface in the form of a flat disc is clamped to the end surface of the blanket-supporting disc 31 by bolt 34. The self-aligning operation occurs only in the case where, as in the press roll of the present invention, the flange 12 with a clamping surface 12*a* is clamped to the supporting head 11 which has a tapered surface 11*a* coinciding with the tapered surface 12*a*. This operation makes the blanket-mounting operation easier.

III. Enhancements of Clamping and Sealing Performances by a Wedge Effect

Figure 7:
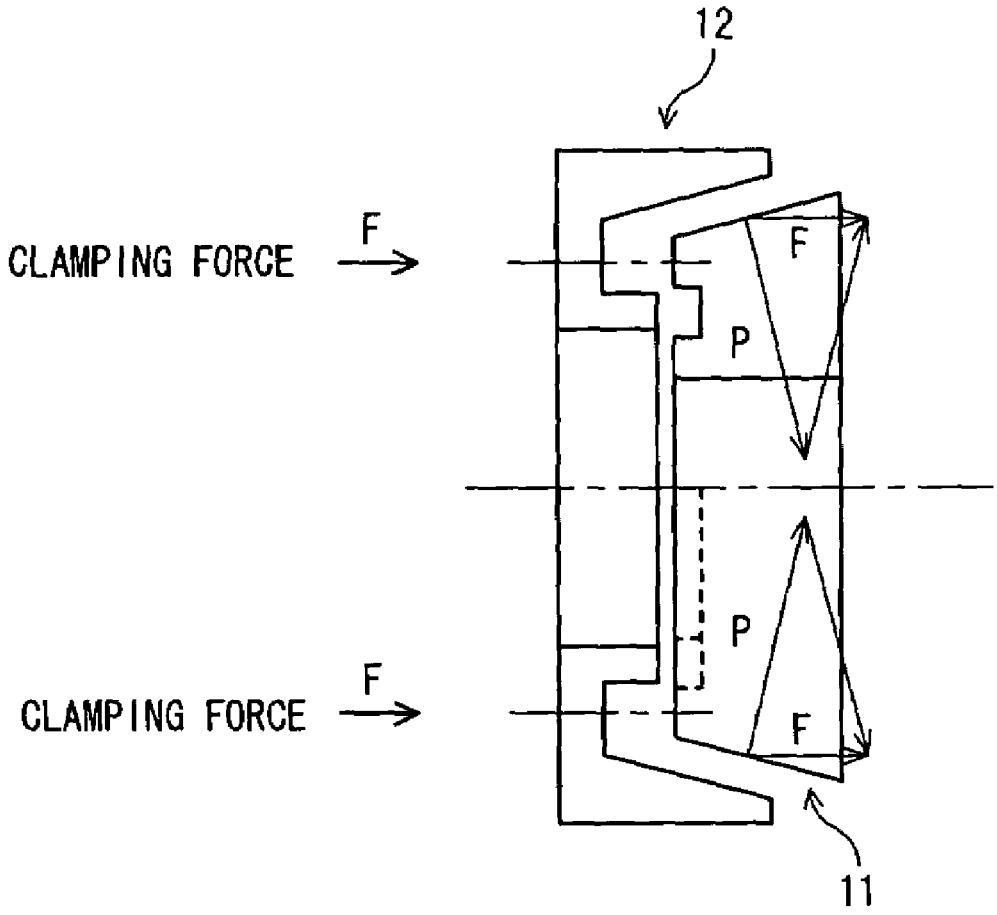
FIG. 7 is an explanatory diagram showing a wedge effect in the press roll of the present invention.

If the blanket is clamped by clamping the flange 12 (which has an inner tapered surface) to the outer peripheral surface of the truncated cone blanket-supporting head 11 with bolts, the blanket can be clamped with greater clamping force P when clamping force F is applied, as shown in FIG. 7. Therefore, clamping and sealing performances can be enhanced compared with the conventional press roll, where a disc flange is clamped to the end surface of a blanket-supporting disc with bolts.

Figure 8A:
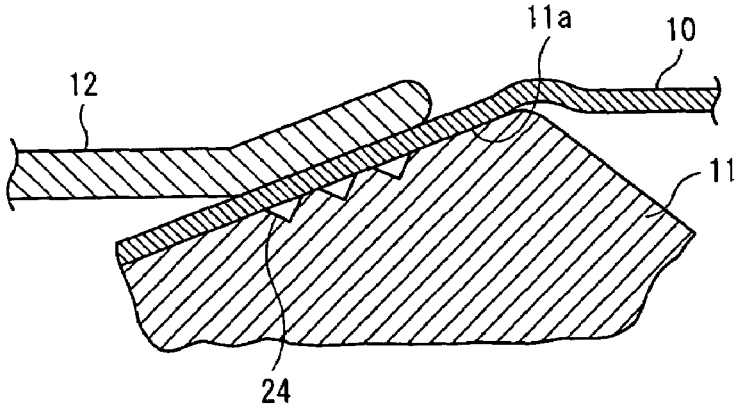
FIG. 8(*a*) is a diagram showing a sealing structure formed in the supporting head, sealing grooves being provided in the first tapered surface of the supporting head in the circumferential direction.
Figure 8B:
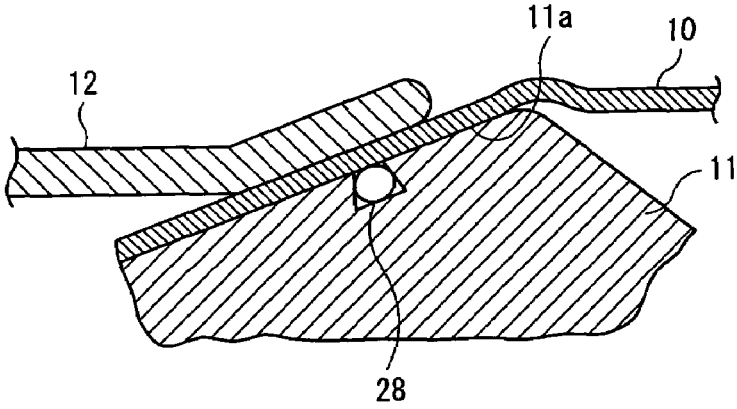

To further enhance the sealing performance, the blanket-supporting head 11 may be provided with ring-shaped grooves. Furthermore, an O-ring, a lip seal, etc., can also be used. That is, in the case where a circumferential groove 24 is provided in the first tapered surface 11*a*, as shown in FIG. 8(*a*), the inner surface of the blanket 10 bites into the groove 24 if the blanket 10 is clamped on the first tapered surface 11*a* with a clamping member 12. As a result, sealing is more reliably performed. The cross section of the above-described groove may be any shape such as a triangle, a rectangle, a trapezoid, a semicircle, etc., as long as the sealing performance is enhanced. As occasion demands, a plurality of grooves may be provided within a range in which the blanket 10 is clamped by the clamping member 12.

In addition, in the case where a circumferential O-ring 28 is provided in the first tapered surface 11*a*, as shown in FIG. 8(*b*), sealing performance is assured by the intimate contact between the blanket 10 and the O-ring 28.

Figure 9:
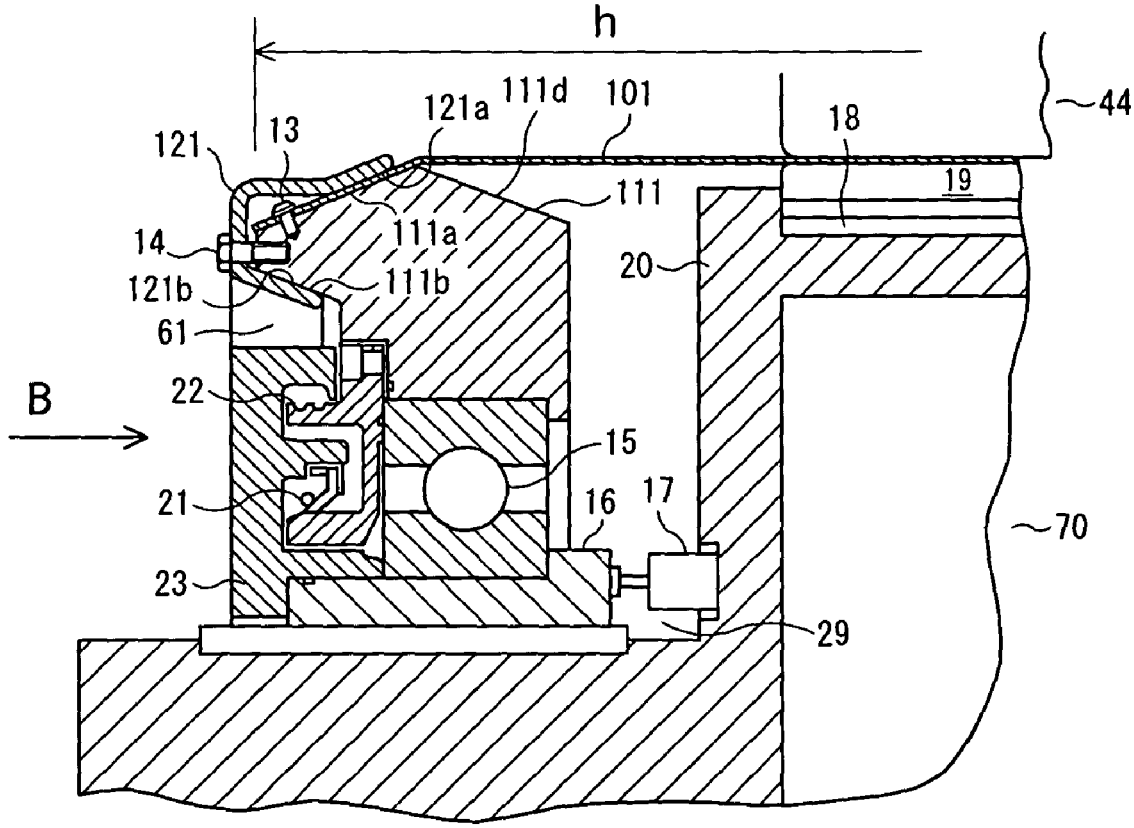
FIG. 9 is a view similar to FIG. 1 showing a press roll constructed in accordance with a first modification of the one embodiment of the present invention.
Figure 10:
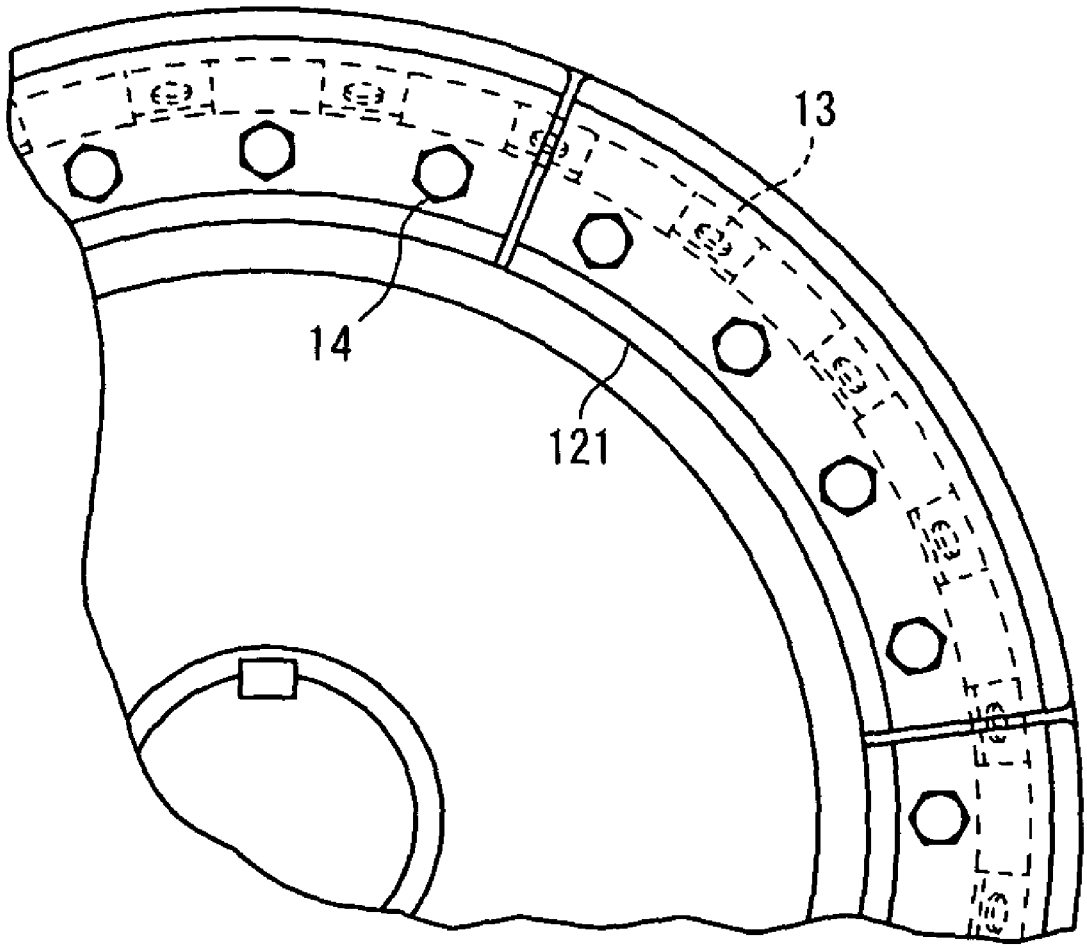
FIG. 10 is a view, taken in the direction of arrow B of FIG. 9, showing the supporting head of the press roll constructed in accordance with the first modification of the one embodiment of the present invention.

Next, a first modification of the above-described embodiment will be described with reference to FIGS. 9 and 10. In this modification, the axially outer end surface of a supporting head 111 has a recess 61 which diminishes in radius toward the axially inner side of the supporting head 111. In addition to a clamping surface 121*a*, a flange (clamping member) 121 has a clamping surface (second clamping surface) 121*b* that coincides with the shape of the inner peripheral surface (second tapered surface) 111*b* of the recess 61. The remaining structure is the same as the aforementioned embodiment.

Therefore, this modification has the same advantages as the aforementioned embodiment. The outer clamping surface (first clamping surface) 121*a* of the flange 121 coincides with the outer tapered surface (first tapered surface) 111*a* of the supporting head 111. The inner clamping surface (second clamping surface) 121*b* of the flange 121 coincides with the inner tapered surface (second tapered surface) 111*b* of a concave recess of the supporting head 111. In this state, clamping is performed. Therefore, in the case where the flange 121 is divided into a plurality of segments in the circumferential direction, the flange 12 in FIG. 1 undergoes the counterclockwise moment produced by the reaction force from the tapered surface 11*a* and tries to rotate, but the flange 121 in FIG. 9 undergoes the clockwise moment produced by the reaction force from the inner tapered surface 111*b* and also undergoes the counterclockwise moment produced by the reaction force from the outer tapered surface 111*a* of the supporting head 111. The two moments of rotation cancel each outer out. Therefore, this modification has the advantage that the flange 121, divided into a plurality of segments, becomes stable.

Figure 11:
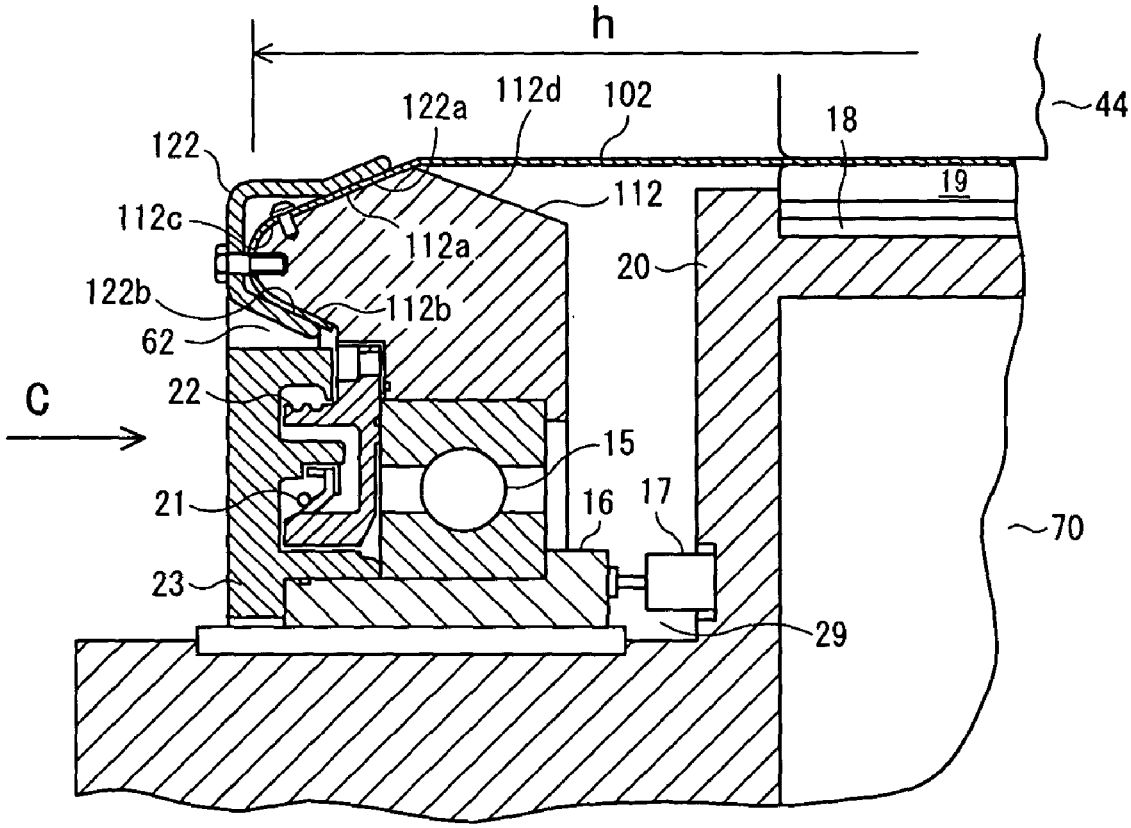
FIG. 11 is a vertical sectional view similar to FIG. 1 showing a press roll constructed in accordance with a second modification of the one embodiment of the present invention.
Figure 12:
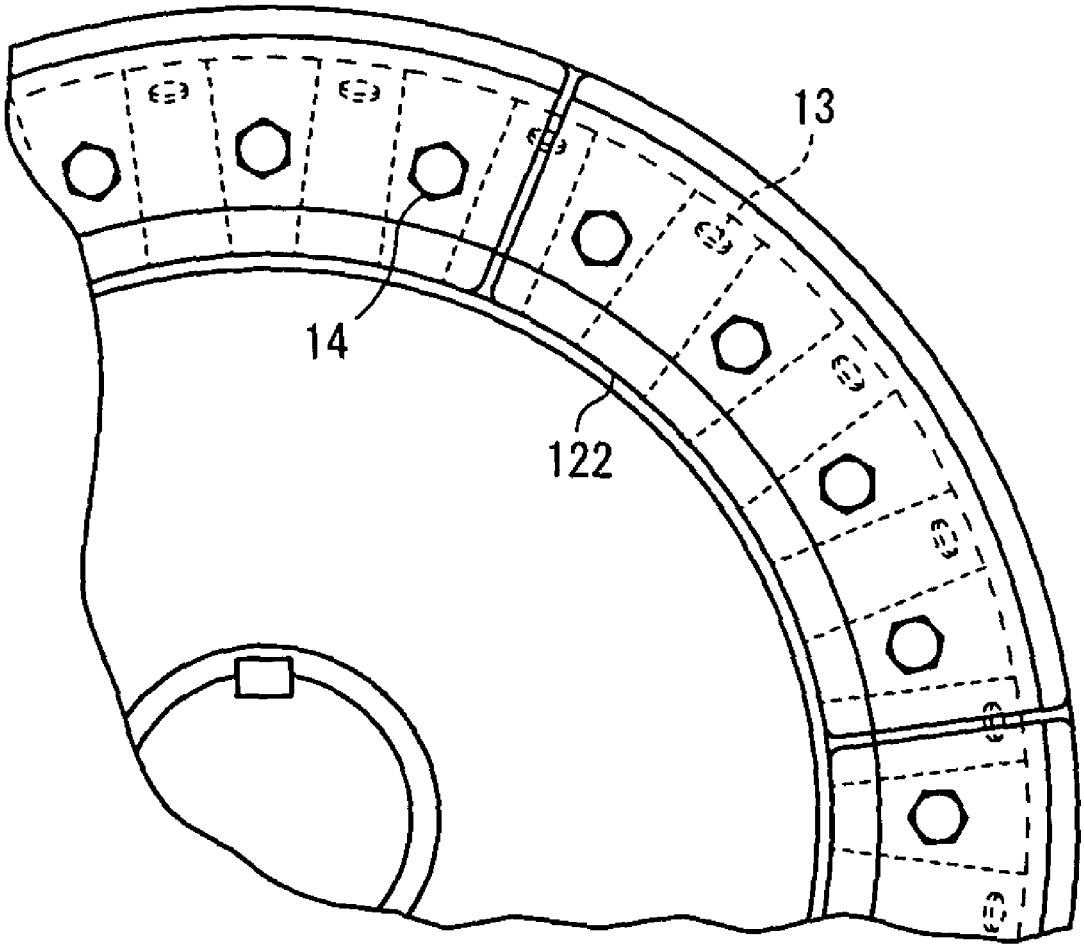
FIG. 12 is a view, taken in the direction of arrow C of FIG. 1, showing the supporting head of the press roll constructed in accordance with the second modification of the one embodiment of the present invention.

A second modification will be described with reference to FIGS. 11 and 12. In this modification, the first modification shown in FIGS. 9 and 10 is further modified. As shown in FIG. 11, the outer periphery of a supporting head 112 has a tapered surface (first tapered surface) 112*a*, an inner tapered surface (second tapered surface) 112*b* of a recess 62, and a surface 112*c* curved convexly in the axially outward direction connecting the two tapered surfaces together. The circumference of the end portion of a blanket 102 is clamped with the outer clamping surface (first clamping surface) 122*a* of a flange (clamping member) 122. At the same time, the tongue portions (tongue pieces) 26 of the blanket 102 extend to the inner tapered surface 112*b* and are clamped with the inner clamping surface (second clamping surface) 122*b*. The remaining structure is the same as the aforementioned first modification.

Therefore, in addition to the advantage of the aforementioned first modification, the second modification has the advantage that the end portions of the blanket 102 become more solid, because the tongue portions 26 of the end portions of the blanket 102 are wound and clamped on the supporting heads 112.

Figure 13:
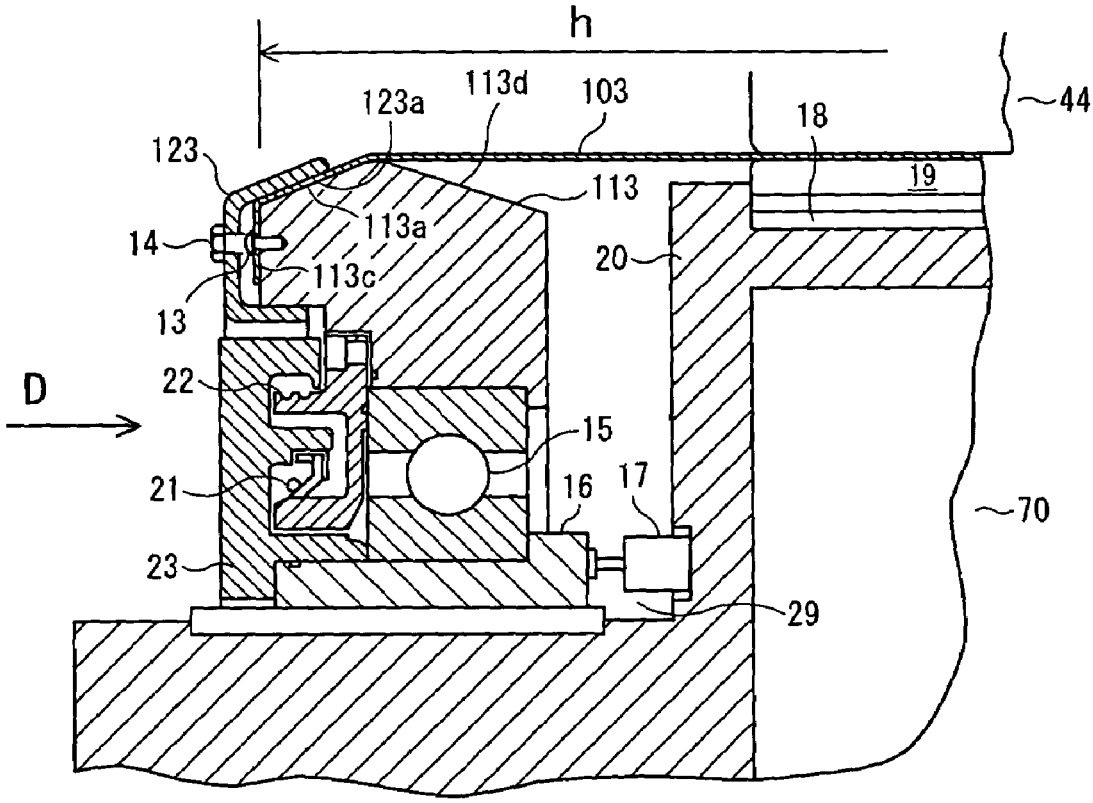
FIG. 13 is a vertical sectional view similar to FIG. 1 showing a press roll constructed in accordance with a third modification of the one embodiment of the present invention.
Figure 14:
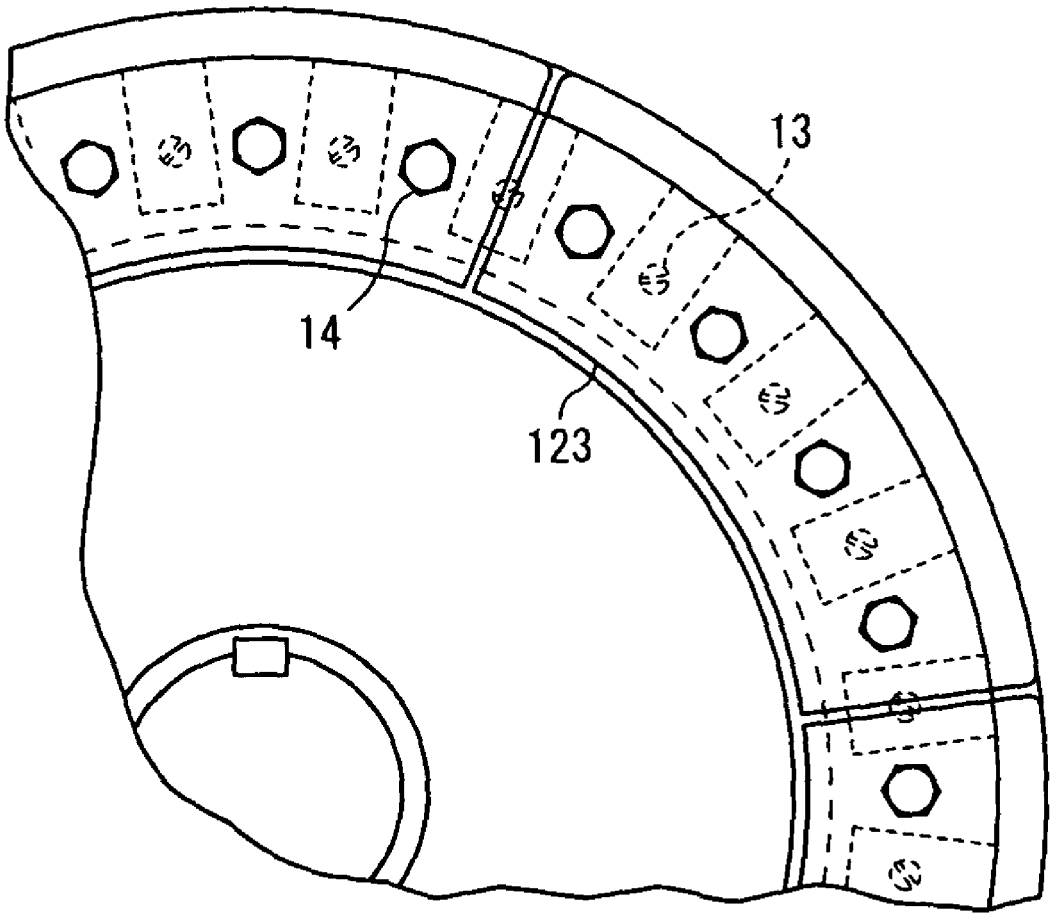
FIG. 14 is a view, taken in the direction of arrow D of FIG. 13, showing the supporting head of the press roll constructed in accordance with the third modification of the one embodiment of the present invention.

A third modification will be described with reference to FIGS. 13 and 14. In this modification, the position of the positioning pins 13 is moved from an outer tapered surface (first tapered surface) 113*a* to an outer end surface 113*c*. The remaining structure is the same as the aforementioned embodiment.

Therefore, the third modification has the same advantages of the aforementioned embodiment. The flange (clamping member) 12 shown in FIG. 1 requires the cylindrical connection portion 12*b* for connecting the clamping portion 12*d* and the attaching portion 12*c* together to avoid interference with the pins 13. However, in the third modification, this connection portion becomes unnecessary because the pins 13 are provided in the outer end surface. As a result, the axial length of the outer tapered surface 113*a* of the supporting head 113 can be shortened. Because of this, the weight of the flange 123 is reduced and handling becomes easy. In addition, the flange (clamping member) 12 shown in FIG. 1 may eliminate the connection portion 12*b* by providing an opening in a portion interfering with the pins 13. Similarly, an advantage of a reduction in the weight of the flange 12 can be obtained.

A fourth modification will be described with reference to FIGS. 15 and 16. In this modification, the first modification and the third modification are combined together. That is, the axially outer end surface of a supporting head 114 has a recess 64, which diminishes in radius toward the axially inner side of the supporting head 114. In addition to a clamping surface (first clamping surface) 124*a*, a flange (clamping member) 124 has a clamping surface (second clamping surface) 124*b* that coincides with the shape of the inner peripheral surface of the recess 64. The remaining structure is the same as the aforementioned third modification.

Therefore, in addition to having the same advantage as the aforementioned third modification, the fourth modification has the advantage that in the case where the flange 124 is divided into a plurality of segments in the circumferential direction, the clamping member 124 becomes more stable, for the same reason described in the first modification (the cross section is more symmetrical).

Figure 17:
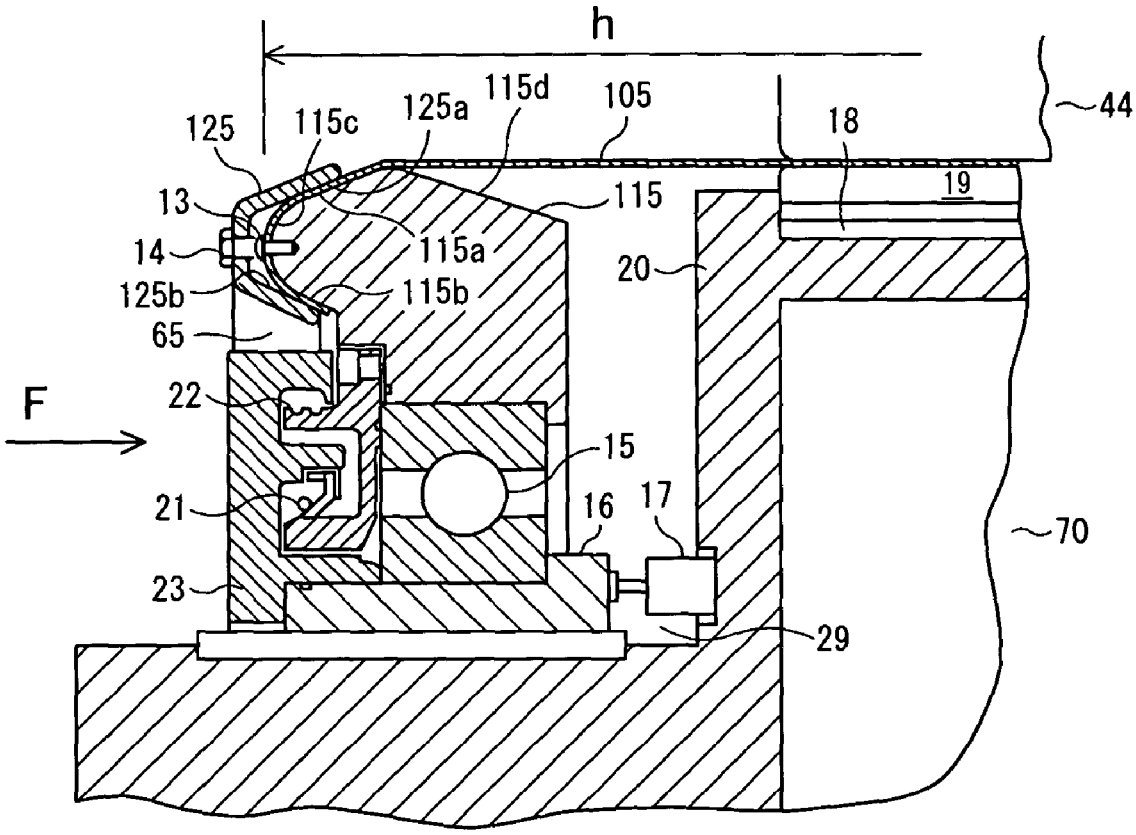
FIG. 17 is a vertical sectional view similar to FIG. 1 showing a press roll constructed in accordance with a fifth modification of the one embodiment of the present invention.
Figure 18:
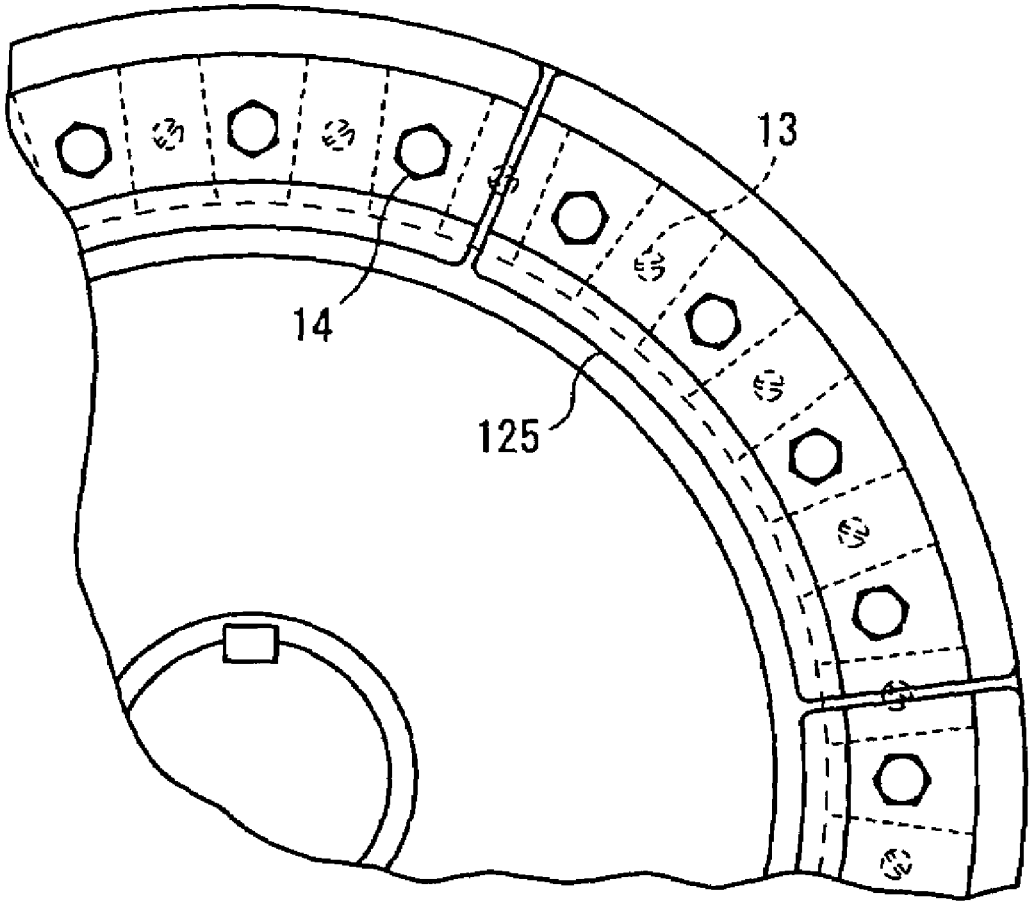
FIG. 18 is a view, taken in the direction of arrow F of FIG. 17, showing the supporting head of the press roll constructed in accordance with the fifth modification of the one embodiment of the present invention.

A fifth modification will be described with reference to FIGS. 17 and 18. In this modification, the second modification and the fourth modification are combined together. That is, the outer periphery of a supporting head 115 has an outer tapered surface (first tapered surface) 115*a*, an inner tapered surface (second tapered surface) 115*b*, and a surface 115*c* curved convexly in the axially outward direction connecting the two tapered surfaces together. The tongue portions 26 of the end portion of a blanket 105 extend to the inner tapered surface 115*b*. As shown in FIG. 17, the end portion of the blanket 105 is clamped with the outer clamping surface (first clamping surface) 125*a* of a flange (clamping member) 125. At the same time, the tongue portions 26 are clamped with the inner clamping surface (second clamping surface) 125*b*. The remaining structure is the same as the aforementioned fourth modification.

Figure 15:
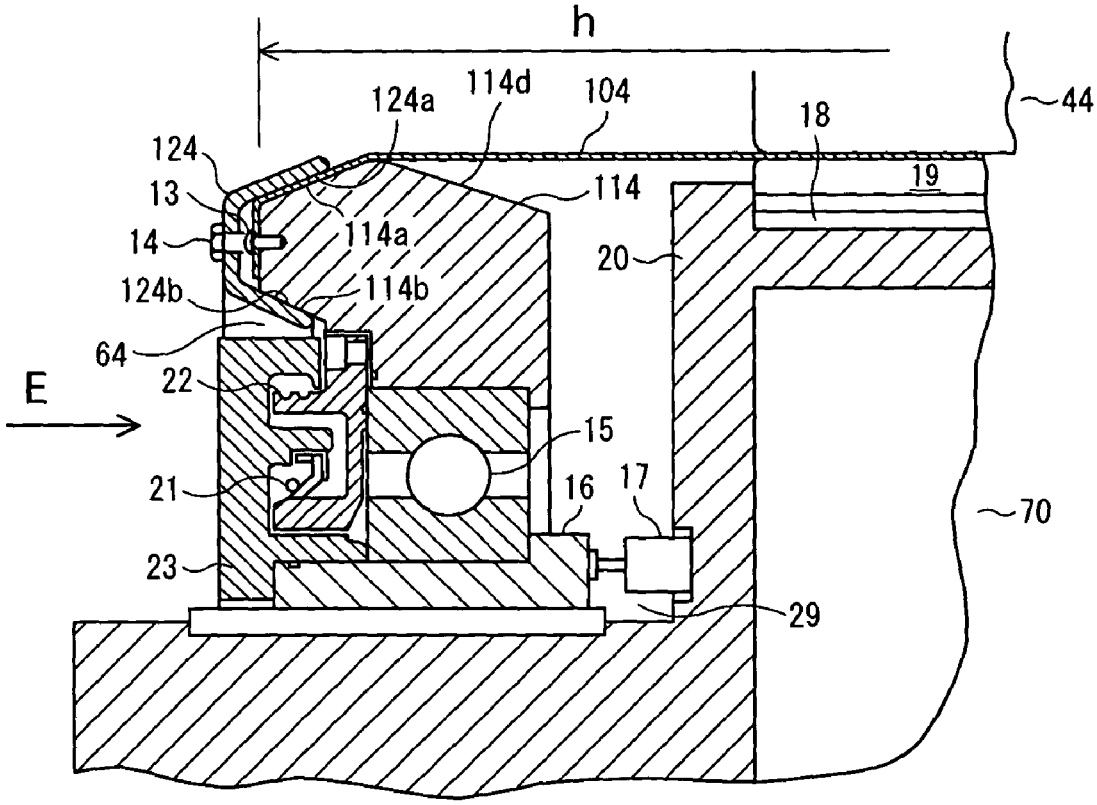
FIG. 15 is a vertical sectional view similar to FIG. 1 showing a press roll constructed in accordance with a fourth modification of the one embodiment of the present invention.
Figure 16:
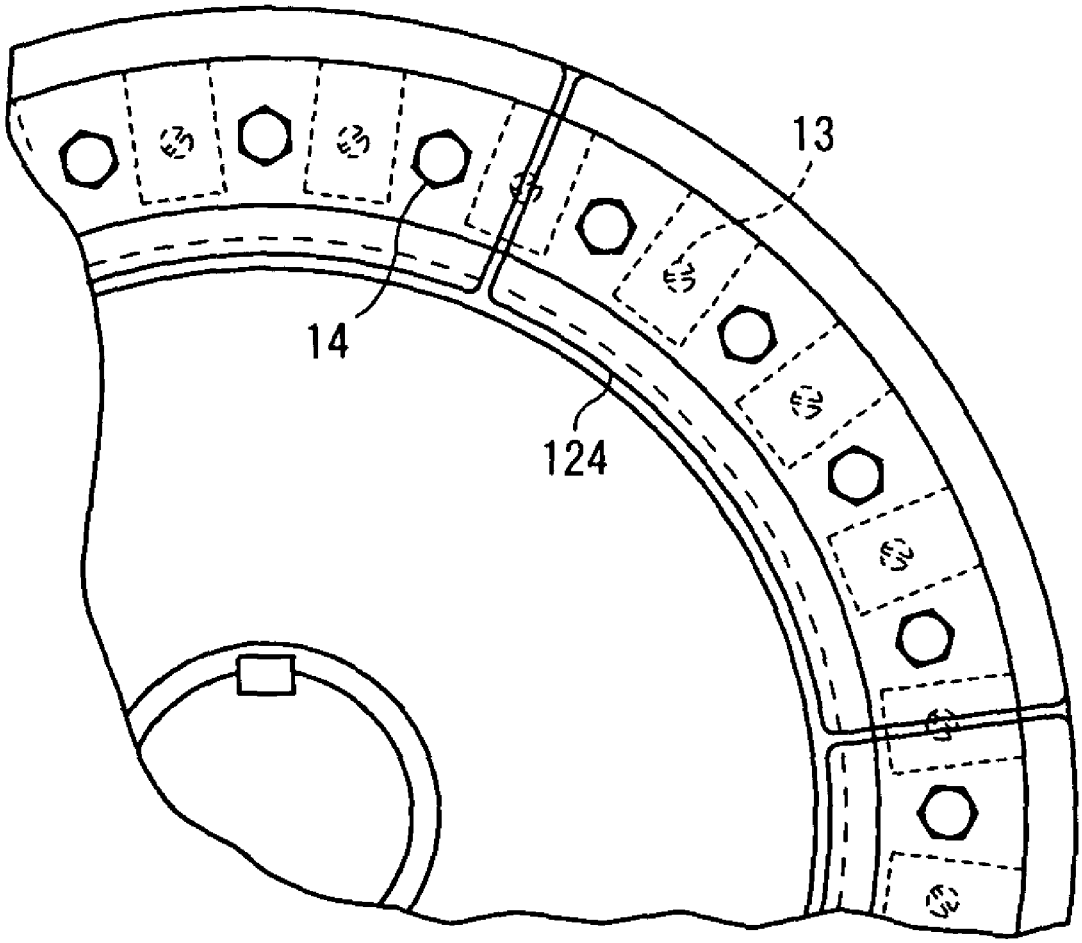
FIG. 16 is a view, taken in the direction of arrow E of FIG. 15, showing the supporting head of the press roll constructed in accordance with the fourth modification of the one embodiment of the present invention.

Therefore, in addition to having the same advantage as the aforementioned fourth modification, the fifth modification has the advantage that the end portions of the blanket 105 is more solid than those shown in FIGS. 15 and 16, because the tongue portions 26 of the end portions of the blanket 105 are wound and clamped on the supporting heads 115.

While the press roll and the blanket mounting method of the present invention have been described with reference to the press roll used to dehydrate a web in the press step of a papermaking machine, the invention is not to be limited to the embodiment and modifications, but may be modified within the scope of the invention hereinafter claimed.

For example, in addition to the press roll used to make a web smooth in the calendering step of a papermaking machine, the present invention is applicable to a press roll in which a web is pressed between a flexible blanket and a roll. Note that in the case of a web press roll that is used in the calendering step, there is no need to provide an endless felt between the flexible blanket and the web.

As described above, the present invention can be suitably employed in a press roll which is employed in the press step, calendering step, etc., of a papermaking machine, and which presses a flexible blanket against a counter roll to apply pressure to a web held between the flexible blanket and the counter roll.

The invention claimed is:

1. A press roll for nipping with a counter roll, said press roll comprising:

a cylindrical blanket having flexibility;

a supporting body disposed within said blanket along a longitudinal axis of said blanket;

supporting heads rotatably supported at both ends of said supporting body for supporting inner surfaces of respective end portions of said blanket;

clamping members provided with respective said supporting heads for clamping respective ends of said blanket to said supporting heads;

fixing members for fixing said clamping members to said supporting heads;

a first tapered surface formed on an outer peripheral surface of each of said supporting heads, each said first tapered surface having an outside diameter that gradually decreases from an inner end to an outer end;

a first clamping surface formed on an inner peripheral surface of each of said clamping members and shaped to fit with said first tapered surface;

a plurality of pins for positioning said blanket on said first tapered surface of said supporting heads;

wherein said blanket is clamped between said first clamping surface and said first tapered surface;

an axially inner tapered surface formed on each of said supporting heads and having an outside diameter that gradually increases from an axially inner end to an axially outer end of said supporting heads;

tongue portions on said end portions of said blanket, said tongue portions each having a bore receiving one of said plurality of pins;

an inner portion formed on each of said clamping members, said inner portion projecting in an axially inner direction of said blanket; and inner peripheral surfaces provided so as to fit with a respective said inner portion and so as to guide each of said clamping members to a fixing position for fixing said clamping members with said fixing members.

2. The press roll of claim 1, wherein said end portions of said blanket are provided with cut-out portions at equal intervals, said tongue portions being provided between said cut-out portions.

3. The press roll of claim 2, wherein:

each of said supporting heads has a conical recess at an axial end surface of said supporting head, a second tapered surface facing said conical recess and being formed on an opposite side of said supporting head with respect to first tapered surface; and each of said clamping members has a second clamping surface on said inner portion of said clamping members fitting with said second tapered surface.

4. The press roll of claim 3, wherein said end portions of said blanket are provided with cut-out portions at equal intervals, said tongue portions being provided between said cut-out portions.

5. The press roll of claim 4, wherein:

each of said supporting heads has a curved surface, connecting said first tapered surface and said second tapered surface, formed on an exterior surface of each of said supporting heads; and at least one of said tongue portions is clamped between said second tapered surface and said second clamping surface.

6. The press roll of claim 5, wherein each of said tongue portions comprises a bore individually receiving a respective on of said pins.

7. The press roll of claim 5, wherein each of said supporting heads has (a) at least one sealing groove or (b) sealing material in said first tapered surface on which said blanket is clamped.

8. The press roll of claim 7, wherein each of said plurality of clamping members is divided into a plurality of segments.

9. The press roll of claim 5, wherein each of said plurality of clamping members is divided into a plurality of segments.

10. The press roll of claim 4, wherein each of said tongue portions comprises a bore individually receiving a respective on of said pins.

11. The press roll of claim 4, wherein each of said supporting heads has (a) at least one sealing groove or (b) sealing material in said first tapered surface on which said blanket is clamped.

12. The press roll of claim 11, wherein each of said plurality of clamping members is divided into a plurality of segments.

13. The press roll of claim 4, wherein each of said plurality of clamping members is divided into a plurality of segments.

14. The press roll of claim 2, wherein each of said tongue portions comprises a bore individually receiving a respective on of said pins.

15. The press roll of claim 2, wherein each of said supporting heads has (a) at least one sealing groove or (b)

sealing material in said first tapered surface on which said blanket is clamped.

16. The press roll of claim 15, wherein each of said plurality of clamping members is divided into a plurality of segments.

17. The press roll of claim 2, wherein each of said plurality of clamping members is divided into a plurality of segments.

18. The press roll of claim 1, wherein each of said supporting heads has (a) at least one sealing groove or (b) sealing material in said first tapered surface on which said blanket is clamped.

19. The press roll of claim 18, wherein each of said plurality of clamping members is divided into a plurality of segments.

20. The press roll of claim 1, wherein each of said plurality of clamping members is divided into a plurality of segments.

* * * * *